US007139494B2

(12) United States Patent
Ono et al.

(10) Patent No.: US 7,139,494 B2
(45) Date of Patent: Nov. 21, 2006

(54) IMAGE FORMING APPARATUS, PART DETACHABLE DEVICE AND IMAGE FORMING APPARATUS MAIN BODY THAT SWITCHES OPERATION MODE BASED PART USED

(75) Inventors: Tomohiro Ono, Ebina (JP); Tamaki Hosoya, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/040,014

(22) Filed: Jan. 24, 2005

(65) Prior Publication Data

US 2005/0244170 A1 Nov. 3, 2005

(30) Foreign Application Priority Data

Apr. 30, 2004 (JP) ..... 2004-135290
May 28, 2004 (JP) ..... 2004-159082

(51) Int. Cl.
*G03G 15/00* (2006.01)

(52) U.S. Cl. ..... 399/12

(58) Field of Classification Search ..... 399/12; 347/7

See application file for complete search history.

(56) References Cited

U.S. PATENT DOCUMENTS 6,212,338 B1 * 4/2001 Hagihara et al. ..... 399/12
6,512,894 B1 * 1/2003 Takemoto et al. ..... 399/12
2005/0078165 A1 * 4/2005 Harada et al. ..... 347/137

FOREIGN PATENT DOCUMENTS

| | | |
|---|---|---|
| JP | 64-57272 | 3/1989 |
| JP | 1-200272 | 8/1989 |
| JP | 11-237816 | 8/1999 |
| JP | 2000-284581 | 10/2000 |
| JP | 2002-331686 | 11/2002 |

* cited by examiner

*Primary Examiner*—William J. Royer
(74) *Attorney, Agent, or Firm*—Morgan, Lewis & Bockius, LLP

(57) ABSTRACT

An image forming apparatus includes an image forming section to which a replaceable part is detachably attached and a switching section for switching an operation mode of the image forming section between an approved part mode corresponding to a case wherein an approved part is attached as the replaceable part and a unapproved part mode corresponding to a case wherein a part other than the approved part is attached.

15 Claims, 12 Drawing Sheets

IMAGE FORMING APPARATUS, PART DETACHABLE DEVICE AND IMAGE FORMING APPARATUS MAIN BODY THAT SWITCHES OPERATION MODE BASED PART USED

BACKGROUND OF THE INVENTION

1. Field of the Invention

The present invention relates to an image forming apparatus on which a replaceable part is detachably mounted, a device having a detachable part and an image forming apparatus main body.

2. Description of the Related Art

Many of today's image forming apparatuses such as copiers or printers are configured as apparatuses in which replaceable parts, such as a drum cartridge or a toner cartridge, are detachably connected to, or mounted on, the main body of the apparatus. A designer of a main apparatus body for such a device ordinarily assumes that any replacement parts attached to the main apparatus body will be parts whose use has been authorized by the manufacturer, such as original or recommended replacement parts, and designs and produces the main apparatus body so as to obtain desired image quality and a safety performance under such conditions.

However, when unauthorized replacement parts, including imitations, counterfeit parts, pirated parts, or the like, are attached to a main apparatus body designed and manufactured as described above, the operational conditions may fall outside the ranges assumed by the designer, and various disadvantages may result. For example, the likelihood of problems regarding the image quality, of malfunction, of failure of the main apparatus body, or of paper damage, such as tears or wrinkles, of printing sheets increases.

In order to avoid the above-described disadvantages, a technique is sometimes utilized in which whether or not amounted replaceable part is a genuine part is automatically detected, and, when it is detected that the mounted part is not a genuine part, an image forming operation is inhibited or an alarm is displayed. Such a technique is disclosed in, for example, Japanese Patent Publication JP-A-2002-331686.

Publication JP-A-1-200272 discloses a technique in which the type of a cartridge including a photosensitive drum is identified, and, when a cartridge of a type other than specified is attached, a warning regarding the attachment of the different cartridge is displayed and a copying operation is inhibited. Further, JP-A-64-57272 also discloses a technique in which, when it is determined that an installed unit has reached the end of its service life, a warning is displayed and activation of the main body (the main body of the device) is stopped.

As described above, use of a replacement part such as an imitation product whose use is not authorized by the manufacturer is not preferable from the viewpoint of safety. However, some consumers desire to use such imitation products. Such a situation is not limited to the image forming apparatus and arises widely in devices to which replaceable parts are detachably attached.

As a method for switching an operation mode of an image forming apparatus such as a copier or printer, a method is known in which a service engineer having special knowledge switches the operation mode using specialized service tools, such as, for example, a control panel service mode, a specialized hand tool, proprietary software running on a PC, or the like. This method is employed when free switching by a user is not preferable from the viewpoint of safety.

However, in the above-described method, the user must very inconveniently contact the service engineer each time the user wishes the operation mode to be switched. Further, the manufacturer or a seller must dispatch the service engineer to the installed place of the image forming apparatus every time the operation mode is switched, which can greatly increase costs and reduce the profitability of service packages.

SUMMARY OF THE INVENTION

An aspect of the present invention provides an image forming apparatus having an image forming section to which a replaceable part is detachably attached and a switching section that switches an operation mode of the image forming section to an approved part mode corresponding to a case wherein an approved part is attached as the replaceable part and to an unapproved part mode corresponding to a case wherein a part other than the approved part is attached.

Another aspect of the present invention provides a part detachable device having an operating section to which a replaceable part is detachably attached and a switching section that switches an operation mode of the operating section to an approved part mode corresponding to a case wherein an approved part is attached as the replaceable part and to an unapproved part mode corresponding to a case wherein a part other than the approved part is attached.

Still another aspect of the present invention provides an image forming apparatus for forming an image on a recording medium, which includes an image forming apparatus main body having multiple operation modes and a replaceable part detachably attached to the image forming apparatus main body. Operation mode switching information for switching the operation modes of the image forming apparatus main body is held in the replaceable part. The image forming apparatus main body switches the operation mode or modes in accordance with the operation mode switching information stored in the replaceable part when the replaceable part is attached.

Still another aspect of the present invention provides an image forming apparatus main body that has multiple operation modes and forms an image on a recording medium by using detachably attached replaceable part. The image forming apparatus main body has an attaching section to which a replaceable part holding operation mode switching information for switching the operation modes can be attached and an operation mode switching section that switches the operation mode on the basis of the operation mode switching information stored in the replaceable part when the replaceable part is attached to the attaching section.

BRIEF DESCRIPTION OF THE DRAWINGS

Embodiments of the present invention will be described in detail based on the following figures in which.

DETAILED DESCRIPTION OF THE INVENTION

Figure 1:
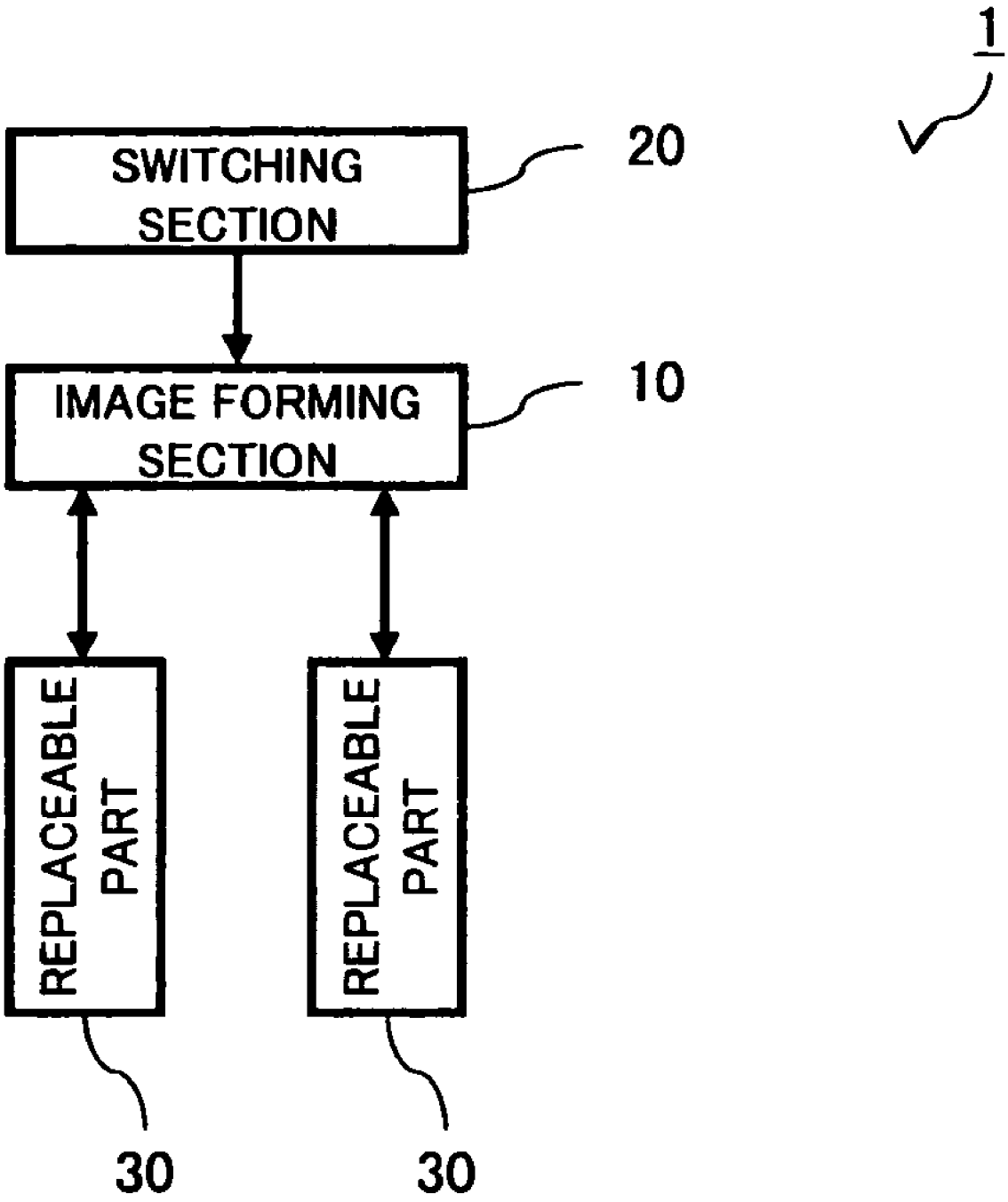
FIG. 1 is a block diagram showing a schematic structure of an image forming apparatus according to a first embodiment of the present invention.

Embodiments of the present invention will be described below by referring to the drawings.

First Embodiment

FIG. 1 is a block diagram showing a schematic structure of an image forming apparatus 1 according to a first embodiment of the present invention. The image forming apparatus 1 is an apparatus such as a copier, printer, fax machine, or the like for printing an image on a recording material, such as a sheet of paper. In the following description, an electro-photographic system is explained as an example of a printing system. However, other systems, such as an ink jet system, may be employed.

In FIG. 1, the image forming apparatus 1 includes an image forming section 10 for forming an image and a switching section 20 for switching an operation mode of the image forming section 10.

The image forming section 10 is an apparatus main body part to which one or more replaceable parts 30 are detachably attached, and is a substantially fixed part. The image forming section 10 uses the attached replaceable parts 30 to perform an image forming operation. Specifically, the image forming section 10 forms a toner image on the recording material on the basis of image data read from an original copy or print data supplied from a personal computer by an electro-photographic process.

The replaceable part 30 is ordinarily a replaceable part which may be suitably replaced by another part when the replaceable part has been exhausted. Examples of replaceable parts 30 include, for example, a drum cartridge, a developing unit, a toner, cartridge, a transfer unit, a fixing unit, or the like.

Ordinarily, a manufacturer of an image forming section 10 assumes that a genuine replaceable part 30 is attached to the image forming section 10 when designing and manufacturing the image forming section 10 so as to obtain a prescribed quality (image quality, durability, safety performance, etc.). Accordingly, when the genuine replaceable part 30 of the manufacturer is attached to the image forming section 10, the prescribed quality can be obtained. Further, replaceable parts may not be limited to the genuine part. When a replaceable part 30 is produced by another manufacturer and its use is permitted by the manufacturer, such as a recommended replacement part or licensed component, a certain degree of quality can be anticipated because operation when the replaceable parts 30 is attached is within the range of the manufacturer's assumptions. In the specification of this application, replaceable parts whose use is approved by the manufacturer, including original parts, recommended parts, or the like, are all commonly referred to hereinafter as "approved parts".

On the other hand, in the open market, replaceable parts 30 whose use is not permitted by the manufacturer, such as imitation parts, counterfeit parts, pirated versions, or the like, may be marketed alongside approved parts, whose use is permitted by the manufacturer. In the specification of this application, the replaceable parts whose use is not approved by the manufacturer, including such imitation parts, counterfeit parts, pirated versions, or the like, are commonly referred to as "unapproved parts".

As described above, some consumers desire to use unapproved parts. However, operation of the device when the unapproved part is attached is beyond the range of the manufacturer's assumptions. Accordingly, when the unapproved part is treated in the same manner as the approved part, various problems may result from the operation outside the assumption.

Thus, in this embodiment, as an operation mode of the image forming section 10, an unapproved part mode for attaching an unapproved part is provided as well as an approved part mode corresponding to cases wherein the approved part is attached to the image forming section. The unapproved part mode is an operation mode that satisfies the desire of the consumer who wishes to use the unapproved part and avoids disadvantages caused by the use of the unapproved part.

More specifically, in the approved part mode, the image forming section 10 provides functions in addition to the minimum function of the image forming apparatus. Here, the minimum function for the image forming apparatus is a function for printing an image on the recording material, that is, an image forming function. On the other hand, in the unapproved part mode, in order to satisfy the desire of the consumer who desires to use the unapproved part, the image forming section 10 restricts the functions provided by the approved part mode to avoid disadvantages (malfunction, failure, or the like) arising from use of the unapproved part while maintaining the image forming function.

The switching section 20 switches the operation mode of the image forming section 10 between the approved part mode and the unapproved part mode. By properly switching the operation mode with the switching section 20, the desires of the consumer who wishes to use the unapproved part can be satisfied, while the disadvantages arising from use of the unapproved part can be avoided. The operation mode may be switched either manually or automatically by the switching section 20.

Figure 2:
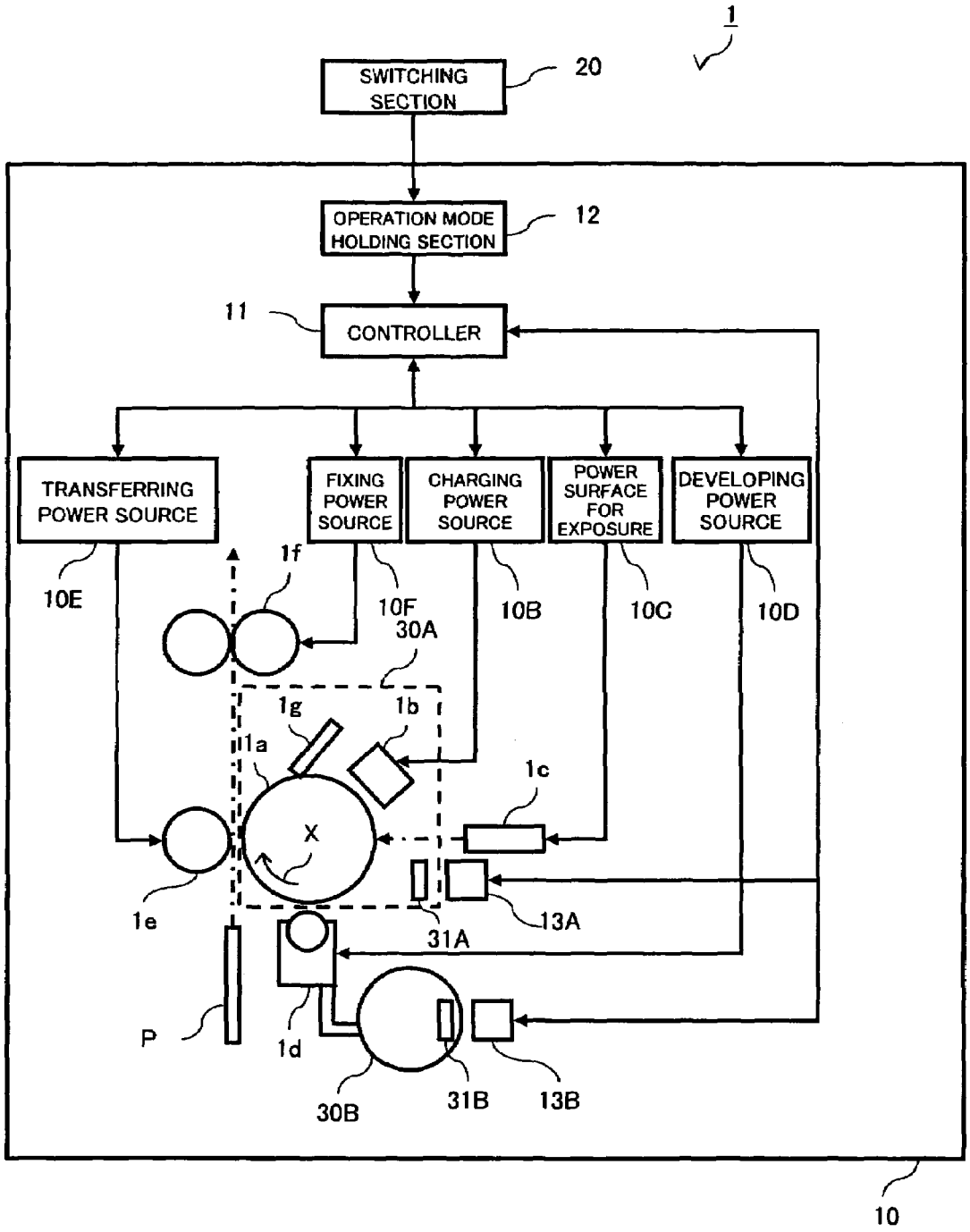
FIG. 2 is a block diagram showing structural details of the image forming apparatus according to the first embodiment of the present invention.

FIG. 2 is a block diagram showing a detailed structure of the image forming apparatus 1 according to this embodiment. Now, by referring to FIG. 2, the structure and operation of the image forming apparatus 1 will be more specifically described.

First, a basic structure related to the formation of an image in the image forming apparatus 1 will be described. The image forming apparatus 1 includes a photosensitive drum 1*a* rotated and driven in a direction shown by an arrow mark X by a motor that is not shown, a charging device 1*b* for uniformly charging the surface of the photosensitive drum 1*a*,a laser scanning optical system (ROS: Raster Output Scanner) 1*c* for forming an electrostatic latent image on the charged surface of the electrified photosensitive drum 1*a*, a developing device 1*d* for developing the electrostatic latent image with toner, a transfer roll 1*e* for transferring a toner image formed on the photosensitive drum 1*a* to a recording material P, a fixing device 1*f* for fixing the transferred toner image on the recording material P, and a cleaner 1*g* for recovering remaining toner on the photosensitive drum 1*a*.

In this embodiment, the photosensitive drum 1*a*, the charging device 1*b*, and the cleaner 1*g* form an integrally formed drum cartridge 30A. The drum cartridge 30A is detachably attached to the image forming section 10 as the replaceable part 30. Further, a toner cartridge 30B with which the toner supplied to the developing device 1*d* is filled is detachably attached to the image forming section 10 as the replaceable part 30.

Members other than the above-described members, that is, the ROS 1*c*, the developing device 1*d*, the transfer roll 1*e* and the fixing device 1*f* are provided on the image forming section 10 side. Further, the image forming section 10 includes a charging power source 10B for applying charging bias to the charging device 1*b*, a power source 10C for exposure for driving a laser light source of the ROS 1*c*, a developing power source 10D for applying developing bias to the developing device 1*d*, a transferring power source 10E for applying transferring bias to the transfer roll 1*e*, and a fixing power source 1OF for supplying electric power to the heater of the fixing device 1*f*. Further, the image forming section 10 is provided with a controller 11 for controlling the entire image forming section 10 including the power sources 10B to 10F. Further, the image forming section 10 is provided with a control panel that is not shown. The control panel is a touch panel type user interface for displays various information and for receiving the input of an instruction of a user. In the specification of this application, "user" includes a manager of an apparatus for managing the image forming apparatus 1 or a service engineer for performing maintenance, as well as an ordinary user.

In this embodiment, the image forming apparatus 1 includes an operation mode holding section 12 in the image forming section 10 side as well as the above-described basic components. The operation mode holding section 12 stores information indicating whether an operation is to be performed in the approved part mode or the unapproved part mode, and the operation mode holding section 12 is a rewritable nonvolatile memory. The information of the operation mode holding section 12 is rewritten by the switching section 20, read by the controller 11, and used for a control by the controller 11. That is, the switching section 20 rewrites the information of the operation mode holding section 12 to switch the operation mode of the image forming section 10.

To the drum cartridge 30A and the toner cartridge 30B, nonvolatile memories 31A and 31B for storing control information used for an image forming operation are respectively attached. The information in the nonvolatile memories 31A and 31B is read and written by reader/writer 13A and 13B provided in the image forming section 10. Here, the non-volatile memory 31 is an RFID (Radio Frequency Identification) tag to transmit the information to and receive the information from the reader/writer 13 by wireless. In this case, the nonvolatile memory 31 is not limited to a specific nonvolatile memory and may transmit the information to and receive the information from the reader/writer 13 through a wired connection.

Now, an example of operation of the image forming apparatus 1 having the above-described structure will be described in detail by dividing the description into description of the overall operation and an operation at the time of the unapproved part mode. Because the general image forming operation of the image forming apparatus 1 is widely known, an explanation thereof is omitted.

Overall Operation of the Image Forming Apparatus 1

Here, as the overall operation of the image forming apparatus 1, a first operational example and a second operational example are described below.

First Operational Example

Figure 3:
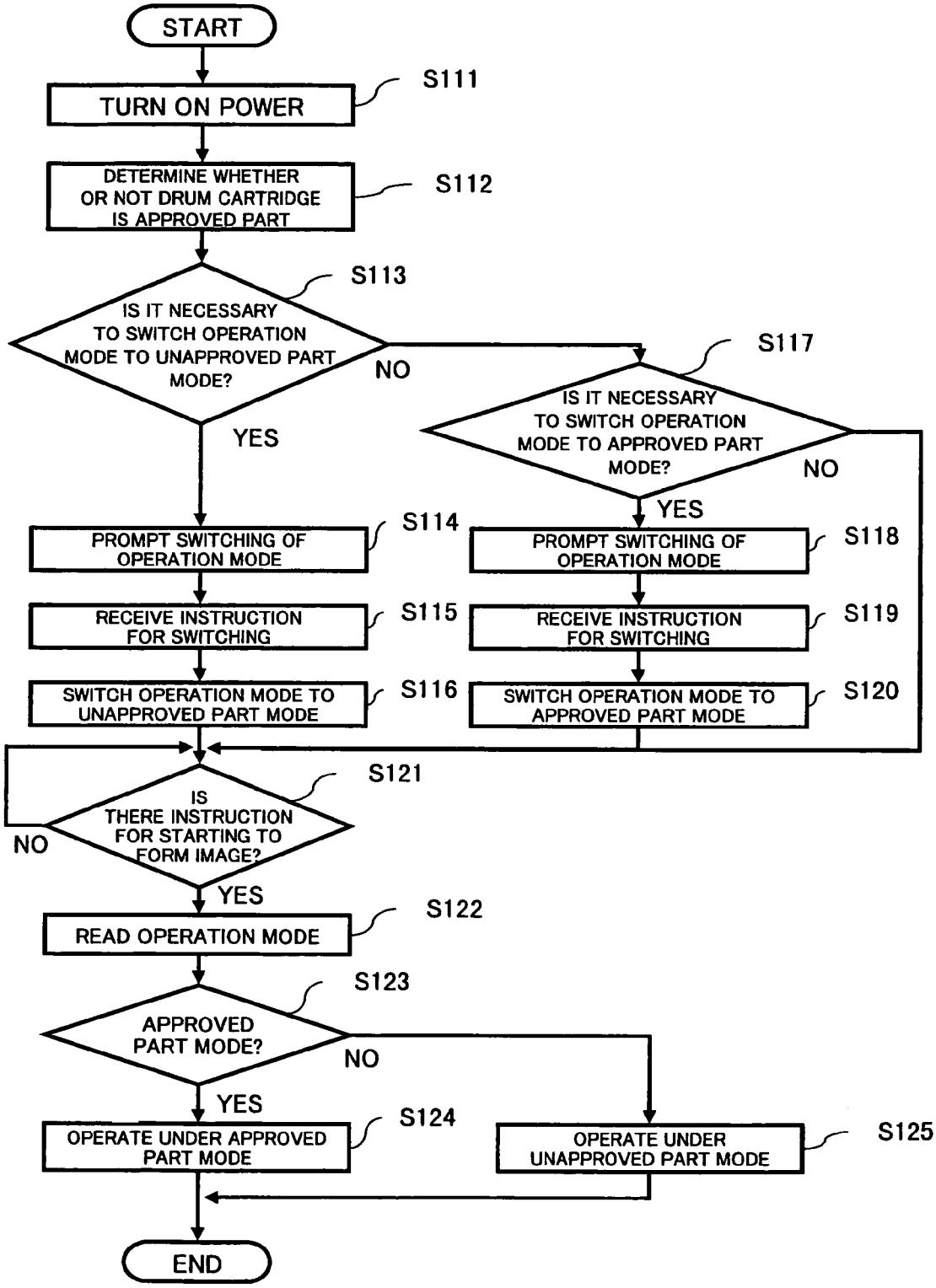
FIG. 3 is a flowchart showing a first operational example of an image forming apparatus according to the present invention.

FIG. 3 is a flowchart showing a first operational example of the image forming apparatus 1. In this operational example, for the convenience of explanation, an example in which the replaceable part 30 is a drum cartridge 30A will be described.

When the power of the image forming apparatus 1 is switched on (S111), the switching section 20 obtains information showing whether or not the cartridge is the approved part from the attached drum cartridge 30A to discriminate whether or not the drum cartridge 30A is the approved part on the basis of the obtained information (S112). For example, the switching section 20 reads encoded information stored in the nonvolatile memory 31A by the reader/writer 13A to decide whether or not the drum cartridge 30A is the approved part depending on whether or not the encoded information can be properly decoded. In such a case, the information showing whether or not the drum cartridge 30A is the approved part may be other information such as a bar code (not shown) attached to the drum cartridge 30A or a physical characteristic value of the drum cartridge 30A. A method for determining whether or not the drum cartridge is the approved part is not limited to a specific method.

Next, the switching section 20 decides whether or not the operation mode must be switched to the unapproved part mode (S113). Specifically, when the drum cartridge 30A is the unapproved part and a current operation mode is the approved part mode, the switching section 20 decides that the operation mode must be switched to the unapproved part mode. The current operation mode is recognized on the basis of the information held by the operation mode holding section 12.

When it is decided that the operation mode must be switched to the unapproved part mode (S113: YES), the user is prompted to switch the operation mode to the unapproved part mode (S114). For instance, on a display screen of the control panel, also not shown, a message urging the user to switch the operation mode may be displayed. When a prescribed switching operation is performed by the user in accordance with the screen, the switching section 20 receives an instruction for switching the operation mode based on the switching operation (S115). Then, the switching section 20 rewrites the information of the operation mode holding section 12 in accordance with the instruction for switching the operation mode to switch the operation mode from the approved part mode to the unapproved part mode (S116)

Here, the prescribed switching operation may be an operation in which a password is input from the user interface such as the control panel. In such a case, the switching section 20 collates the input password with a previously held password and receives the instruction for switching the operation mode when the input password corresponds to the previously held password. At this point, when only a specific person, such as the manager of the apparatus or the service engineer, knows the password, the switching operation may be limited to that person. However, the specific manner of the switching operation is not limited. The switching operation includes an input operation from a screen for an ordinary user of the control panel by the ordinary user, an input operation from a screen for the manager of the control panel by the manager of the apparatus, an input operation from a screen for the engineer of the control panel by the service engineer, an input operation from an apparatus for maintenance (a personal computer, etc.), a connection of a switching jig to the image forming apparatus 1, or an input operation via a network such as the internet or a LAN. When the switching operation is not performed, the image forming operation is preferably inhibited from the viewpoint of preventing disadvantages such as a malfunction.

When it is decided that the operation mode need not be switched to the unapproved part mode (S113: NO), the switching section 20 decides whether or not the operation mode must be switched to the approved part mode (S117). Specifically, when the drum cartridge 30A is the approved part and a current operation mode is the unapproved part mode, the switching section 20 decides that the operation mode must be switched to the approved part mode.

When it is decided that the operation mode must be switched to the approved part mode (S117: YES), the switching section 20 urges the user to switch the operation mode to the approved part mode (S118). For example, a screen prompting switching of the operation mode may be displayed on a display screen, such as a control panel that not shown. When a prescribed switching operation is performed by the user in accordance with the prompting, the switching section 20 receives an instruction for switching the operation mode based on the switching operation (S119). Next, the switching section 20 rewrites the information of the operation mode holding section 12 in accordance with the instruction for switching the operation mode to switch the operation mode from the unapproved part mode to the approved part mode (S120). When the switching operation is not carried out, for instance, while the unapproved part mode is maintained, the image forming operation is permitted.

When it is decided that the operation mode need not be switched to the approved part mode (S117: NO), the procedure moves to step S121. In this case, the operation mode is not switched.

When processes related to the switching operation of the operation mode are finished, the image forming apparatus 1 waits until the image forming apparatus receives an instruction for forming an image, such as the pressing of a start button or the receipt of a request for printing (S121: NO). Then, when the image forming apparatus receives the instruction for starting to form an image (S121: YES), the controller 11 reads the information held by the operation holding section 12 (S122).

When information indicating that the image forming section is to be operated under the approved part mode is read (S123: YES), the controller 11 controls the power sources 10B to 1OF so that the image forming section 10 operates under the predetermined approved part mode (S124). On the other hand, when information to the effect that the image forming section is to be operated under the unapproved part mode is read (S123: NO), the controller 11 controls the power sources 10B to 1OF so that the image forming section 10 operates under the predetermined unapproved part mode (S125). Thus, the image forming apparatus 1 performs the image forming operation suitable for the drum cartridge 30A as the approved part or the unapproved part.

In this operational example, the operation mode is switched in accordance with the switching operation of the user. However, the switching section 20 may automatically switch the operation mode. Further, the user may discriminate whether or not the drum cartridge 30A is the approved part from the external appearance of the drum cartridge 30A or a package thereof to perform the switching operation of the operation mode in accordance with the discriminated result.

Second Operational Example

Figure 4:
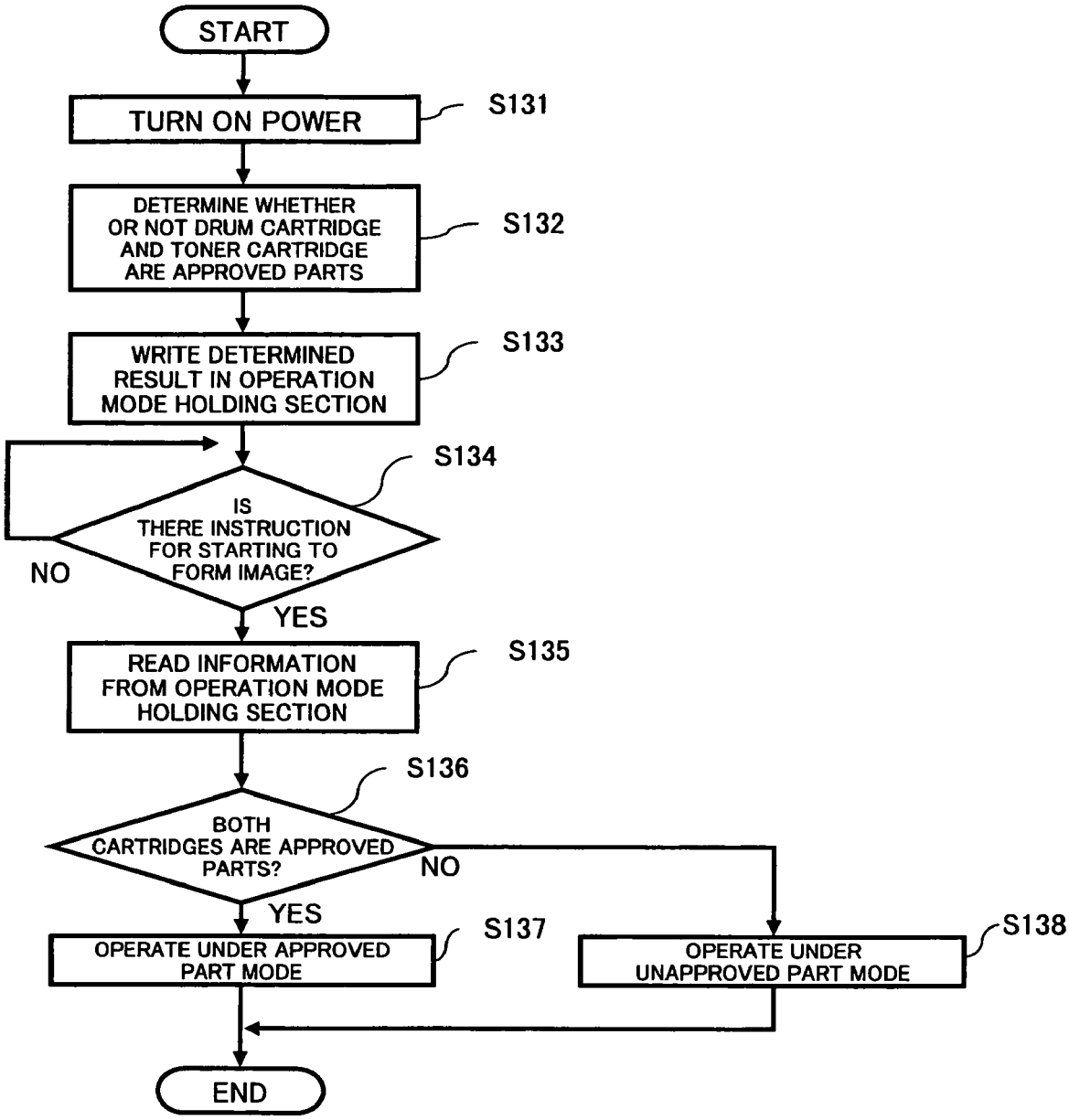
FIG. 4 is a flowchart showing a second operational example of an image forming apparatus according to the present invention.

FIG. 4 is a flowchart showing a second operational example of the entire part of the image forming apparatus 1. In this operational example, as the replaceable part 30, both the drum cartridge 30A and the toner cartridge 30B are taken into consideration. Further, to avoid duplicated description, components common to the first operational example will not be described again.

When power of the image forming apparatus 1 is turned on (S131), the switching section 20 determines whether or not the drum cartridge 30A and the toner cartridge 30B are respectively the approved parts (S132). Then, the result of the determination is written in the operation mode holding section 12 (S133). Accordingly, in the operation mode holding section 12, information showing whether the drum cartridge 30A and the toner cartridge 30B are respectively the approved parts or the unapproved parts is held.

When the information is completely written by the switching section 20, the image forming apparatus 1 waits until the image forming apparatus receives an instruction for starting image formation (S134: NO). Then, when the apparatus receives an instruction for beginning image formation (S134: YES), the controller 11 reads the information held by the operation mode holding section 12 (S135).

When both the drum cartridge 30A and the toner cartridge 30B are the approved parts (S136: YES), the controller 11 controls the power sources 10B to 1OF so that the image forming section 10 operates under the approved part mode (S137). On the other hand, otherwise, that is, when at least one of the drum cartridge 30A and the toner cartridge 30B is the unapproved part (S136: NO), the controller 11 controls the power sources 10B to 1OF so that the image forming section 10 operates under the unapproved part mode (S138). At this point, the controller 11 preferably controls the image forming section 10 depending on which of the replaceable part 30 is the unapproved part. That is, the unapproved part mode is preferably set for each combination of the unapproved parts. For instance, when only the drum cartridge 30A is the unapproved part, the controller 11 limits the charging bias. When only the toner cartridge 30B is the unapproved part, the controller 11 stops a display function of a remaining quantity of toner. When both the drum cartridge and the toner cartridge are the unapproved parts, the charging bias is limited and the display function of the remaining quantity of toner is stopped. Thus, proper control can be performed corresponding to the combination of the unapproved parts.

In the first and second operational examples, when the power is turned on, whether or not the replaceable part 30 is the approved part is discriminated. However, whether or not the replaceable part 30 is the approved part can be discriminated at a suitable timing such as a time when the replaceable part 30 is attached or a time when the opening and closing operation of a main body cover is detected.

Operation in Unapproved Part Mode

Next, an operation in unapproved part mode will be described by comparing it with an operation in approved part mode. Here, the operation is classified into first to fifth operational examples which will be explained. These operational examples may be suitably combined together.

First Operational Example

First, the approved part mode will be described. Generally, in the image forming apparatus 1, some variations in the replaceable part 30 result during production. For example, unevenness in the charging characteristics or the sensitivity of the photosensitive drum 1*a* may be created during production. Further, the characteristics of the replaceable parts 30 change with the use thereof. For example, as the photosensitive drum 1*a* is used, its surface layer is stripped off, and the charging characteristics or the sensitivity of the photosensitive drum change. Such unevenness in production or change characteristic with use gives an influence to an image.

Thus, to compensate for variations in production or changes in characteristics, the image forming section 10 obtains the attribute information of the replaceable parts from the replaceable parts 30 in the approved part mode and operates on the basis of the attribute information. Here, examples of the attribute information include information stored in the nonvolatile memory 31, bar codes (not shown) attached to the replaceable part 30, physical characteristic value of the replaceable part 30, and combinations of such information.

The operation in the approved part mode will be described in more detail using control of the charging bias as an example. The controller 11 reads correcting data for correcting the unevenness of the charging characteristics of the drum cartridge 30A in production from the nonvolatile memory 31A through the reader/writer 13A before a printing job. The correcting data is written in the nonvolatile memory 31A during a producing step of the drum cartridge 30A. The controller 11 corrects a previously set reference charging bias value by the correcting data, and the controller 11 controls the charging power source 10B to output the corrected charging bias. Thus, the surface of the photosensitive drum 1*a* can be charged to a desired potential irrespective of the unevenness in production of the drum cartridge 30A.

It is to be understood that the attribute information obtained from the replaceable part 30 is not used only to correct the unevenness in production or the change of the characteristics.

Next, the unapproved part mode will be described. For example, when the drum cartridge 30A is the unapproved part, unsuitable information may be possibly written in the nonvolatile memory 31A of the drum cartridge 30A. Further, the photosensitive drum 1*a* or the charging device 1*b* forming the drum cartridge 30A may have its characteristics different from those of the approved part. Accordingly, attribute information obtained from the replaceable part 30 of the unapproved part may probably completely different from that of the approved part. When the attribute information is employed for the control of the image forming section 10, disadvantages such as operation other than desired, malfunction, or failure may possibly arise.

Thus, in order to avoid such disadvantages, in the unapproved part mode of this operational example, the image forming section 10 operates on the basis of information previously held by the image forming section 10 in place of the attribute information obtained from the replaceable part 30.

The operation in the unapproved part mode will be more specifically described below using control of the charging bias as an example. In the unapproved part mode, the controller 11 reads the charging bias value for the unapproved part previously held in a prescribed storing area from the storing area of the image forming section 10. Then, the controller 11 controls the charging power source 10B to output the charging bias value for the unapproved part. Here, the charging bias value for the unapproved part is preferably a setting value that considers a safety before an image quality. The charging bias value for the unapproved part is not limited to a fixed value and may be a variable value. For example, the charging bias value for the unapproved part may be a value varying in accordance with a factor such as environmental temperature or an adjustable value by a user.

Second Operational Example

In the approved part mode, the image forming section 10 obtains the attribute information of the replaceable part from the replaceable part 30 and uses the attribute information to realize a prescribed function. For example, the controller 11 reads the residual quantity information of toner from the nonvolatile memory 31B of the toner cartridge 30B to display the remaining quantity of toner on the control panel using the residual quantity information of toner. Thus, the user can ascertain the amount of toner remaining. Here, the residual quantity information of toner that is held by the nonvolatile memory 31B is information having an initial value set during a producing step and updated by the controller 11 every time the printing job is generated.

When the toner cartridge 30B is the unapproved part, the initial value set during the producing step may be possibly improper. Further, the materiality of the toner is different from that of the approved part, the residual quantity information of toner may not be possibly precisely updated. Therefore, when the residual quantity information of toner is read from the toner cartridge 30B as the unapproved part and the residual quantity of toner is displayed on the basis thereof, inaccurate information may be undesirably provided to the user.

Thus, in the unapproved part mode of this operational example, the image forming section 10 stops the prescribed function realized by using the attribute information obtained from the replaceable part 30 such as a display function of the residual quantity of toner. However, the image forming section 10 maintains other properly realizable functions.

The display function of the residual quantity of toner is described as an example herein. However, the prescribed function realized by using the attribute information of the replaceable part 30 is not limited to a specific function.

Third Operational Example

The approved part mode is set so that prescribed qualities (image quality, durability, safety, etc.) are obtained when the approved part is attached as the replaceable parts 30. Specifically, parameters such as the charging bias, transfer bias, fixing temperature, etc. in the approved part mode are set on the assumption that the replaceable parts 30 satisfy prescribed characteristics (for example, withstand voltage, incombustibility, wear performance, etc.).

When the replaceable part 30 is the unapproved part, it is obscure whether or not the above-described prescribed characteristics are satisfied. Accordingly, when the unapproved part is attached, if the parameters of the approved part mode are directly applied, disadvantages such as discharge, rise in temperature, current overload, wearing out of parts, etc. may arise.

Thus, in the unapproved part mode of this operational example, the image forming section 10 operates within an operation restricted range more strict than that of the approved part mode. For example, upper limits or lower limits more strict than those of the approved part mode are set to the output values of the charging bias, a quantity of laser beam, the transfer bias, the fixing temperature, etc. Here, the operation restricted range in the unapproved part mode is preferably set in view of preventing a failure or ensuring a safety. Further, upper limits or lower limits stricter than those of the approved part mode may be set to a continuously operating time, a number of continuously outputted sheets, printing speed (process speed), etc. The operation restricted range may be sometimes specified by means except the upper limits or the lower limits. For example, a usable printing mode (an ordinary sheet mode, a thin sheet mode, a thick sheet mode, etc.) may be restricted or the usable recording material (an ordinary sheet, a thin sheet, a thick sheet, OHP, etc.) may be restricted.

Fourth Operational Example

As described in the above-described first to third operational examples, the operations of the image forming apparatus 1 are different between the approved part mode and the unapproved part mode. Accordingly, the user may erroneously recognize the operation at the time of the unapproved part mode to be the failure of the image forming apparatus 1. It is preferable that the user who does not know that the unapproved part is attached is informed of the attachment of the unapproved part.

Thus, in the unapproved part mode of this operational example, the user is informed that a current operation mode is the unapproved part mode. For example, the fact that the device is in unapproved part mode is displayed on the display screen of the control panel or a personal computer. However, the method of communicating this information is not limited, and the information may be communicated using audio means. Further, in the approved part mode, the user may be informed that the current operation mode is the approved part mode.

Fifth Operational Example

Even when the unapproved part is attached, an image of higher quality can be preferably obtained and a higher functionality can be desirably realized. Further, a manufacturer can examine or obtain the attribute information, such as the materials or performance, of the unapproved part.

Thus, in the unapproved part mode of this operational example, the image forming section 10 obtains identifying information showing a manufacturer's name or a product name of the replaceable parts 30 and performs a preset operation in accordance with a manufacturer or a product recognized from the identifying information.

Specifically, in the image forming section 10, control information is preset for each of manufacturer names and product names. Here, the control information indicates information used for a control by the image forming section 10. The control information is the information for controlling, for example, the charging bias, the quantity of laser beam, the fixing temperature, etc. Control information corresponding to a certain unapproved part is determined on the basis of characteristics of the product (for example, sensitivity of a photosensitive member, toner melting point, etc.).

The image forming section 10 receives an input manufacturer name and product name from the user through the user interface such as the control panel. Otherwise, the image forming section 10 reads the manufacturer's name or the product name from the nonvolatile memory 31 or the bar code of the replaceable parts 30. However, in this case, the product name or the like must be previously recorded on the replaceable parts 30 by the manufacturer of the unapproved part. The image forming section 10 performs the image forming operation on the basis of the control information corresponding to the obtained manufacturer name or product name.

In the unapproved part mode of this operational example, to obtain the image of higher quality, or to realize the higher function, the image forming section 10 may obtain the attribute information of the replaceable parts from the replaceable parts 30 as the unapproved part and operate by using the attribute information. Here, examples of the attribute information include, for example, information stored in the nonvolatile memory 31, the bar code attached to the replaceable part 30, the physical characteristic value of the replaceable part 30, and combinations of such information.

According to the above-described embodiment, the below-described effects can be achieved.

(1) As the operation mode of the image forming section, not only the approved part mode corresponding to a case that the approved part is attached, but also the unapproved part mode corresponding to a case that the unapproved part is attached is provided. These modes are switched and used. Thus, while the desire of the consumer who wishes to use an unapproved part is satisfied, disadvantages such as operation other than expected, problems in view of the image quality, malfunctions, failure, etc. resulting from use of the unapproved part can be avoided.

(2) The image forming section obtains the attribute information of the replaceable parts from the replaceable parts in the approved part mode and operates on the basis of the attribute information. In the unapproved part mode, the image forming section operates on the basis of the information previously held in the image forming section in place of the attribute information. In the unapproved part mode, because the attribute information of the replaceable parts is not used for the image forming operation, the function of the image forming apparatus is partly restricted. However, while the desire of the user who wishes to use the unapproved part is satisfied, the disadvantages such as the operation outside expectation, failure, etc. due to the use of improper attribute information can be avoided.

Further, when an operation for obtaining the attribute information from the replaceable parts such as a communication with the nonvolatile memory is omitted, the amount of time required for obtaining the attribute information can be reduced to enable operation at higher speed. Further, the disadvantages such as the malfunction or the failure, etc. due to the input of the attribute information that is not anticipated can be avoided.

(3) The image forming section obtains the attribute information of the replaceable parts from the replaceable parts in the approved part mode to realize the prescribed function by using the attribute information. In the unapproved part mode, the prescribed function is stopped. According to the unapproved part mode, because the prescribed function based on the attribute information of the replaceable parts is stopped, apart of functions of the image forming apparatus is not realized. However, while the desire of the user who wishes to use the unapproved part is satisfied, the disadvantages such as the operation outside expectation, failure, etc. due to the use of improper attribute information can be avoided.

Further, when an operation for obtaining the attribute information from the replaceable parts such as a communication with the nonvolatile memory is omitted, a time required for obtaining the attribute information can be saved to perform the operation at high speed. Further, the disadvantages such as the malfunction or the failure, etc. due to the input of the attribute information that is not anticipated can be avoided.

(4) The image forming section operates, in the unapproved part node, within the operation restricted range that considers a safety and is more strict than that of the approved part mode. According to the unapproved part mode, because the operation or output is restricted, performance characteristics, such as image quality, of the image forming apparatus are deteriorated. However, while the desire of the user who wishes to use the unapproved part is satisfied, unexpected output, rise in temperature, current overload, wearing out of parts, failure, or deterioration of parts as a result of the use of the unapproved part can be avoided.

(5) The image forming section informs the user that the current operation mode is the unapproved part mode in the unapproved part mode. According to the unapproved part mode, the user can grasp that the current operation mode is the unapproved part mode. Accordingly, the user can be prevented from unnoticing the attachment of the unapproved part. Further, the user can be prevented from erroneously recognizing the restriction of functions at the time of the unapproved part mode to be a failure.

(6) The image forming section obtains the identifying information showing the manufacturer's name or the product name of the replaceable parts and performs the preset operation in accordance with the manufacturer or the product recognized from the identifying information. According to the unapproved part mode, when the unapproved part is used, a preferable image forming operation can be achieved to improve the quality of the image or realize high functions. In the unapproved part mode, when the image forming section obtains the identifying information from the replaceable parts, a suitable image forming operation can be automatically carried out in accordance with the manufacturer or the product. Thus, a utility is improved. Further, in the unapproved part mode, when the image forming section operates on the basis of the attribute information obtained from the replaceable parts, a preferable image forming operation can be achieved upon using the unapproved part to more improve the quality of the image or realize higher functions.

(7) When the switching section switches the operation mode in accordance with a switching operation by the user, the user can switch the operation mode depending on the intention of the user. Here, if a person who can perform the switching operation is limited to the manager of the apparatus or the service engineer, an ordinary user can be prevented from erroneously switching the operation mode.

(8) When the switching section obtains the prescribed information from the replaceable parts to discriminate whether or not the replaceable parts is the approved part on the basis of the information and switch the operation mode in accordance with the discriminated result, the operation mode can be automatically switched to improve a utility. Further, even when the user erroneously unintentionally attaches the unapproved part, disadvantages due to the use of the unapproved part can be avoided.

In the above-described examples of the embodiment, the drum cartridge, the developing unit, the toner cartridge, the transfer unit, and the fixing unit were described as example replaceable parts. However, the replaceable parts are not limited thereto. In addition thereto, a sheet conveying roll, a sheet tray, an image input device (IIT), an image data forming device, an optional device or the like, may be employed. As the optional device, a double side conveying device, a tray-less double side conveying device, a finisher (a post-treatment device such as stapling, binding, punching, folding machine), a large capacity of sheet feed tray, a large capacity of sheet catch tray, a manual sheet feed tray, a special sheet conveying device, etc. may be employed.

Further, in the above-described embodiment, the image forming apparatus is described as an example. However, the present invention may be widely applied to a part detachable device to which a replaceable part is detachably attached. Here, as the part detachable device, for example, a television, a data recording and reproducing device (a video, a hard disk recorder or the like), a speaker, a fixed telephone, a portable telephone, a personal computer, a motor vehicle, etc. may be exemplified. In the data recording and reproducing device, as one of the replaceable parts, a recording medium such as a magnetic tape, a magnetic disk, an optical disk, a magnetic optical disk, a memory card, a paper tape or the like is exemplified. Further, in the motor vehicle, as the replaceable parts thereof, a tire, a muffler, a battery, an air cleaner, oil cleaner, light, etc. may be exemplified.

Figure 5:
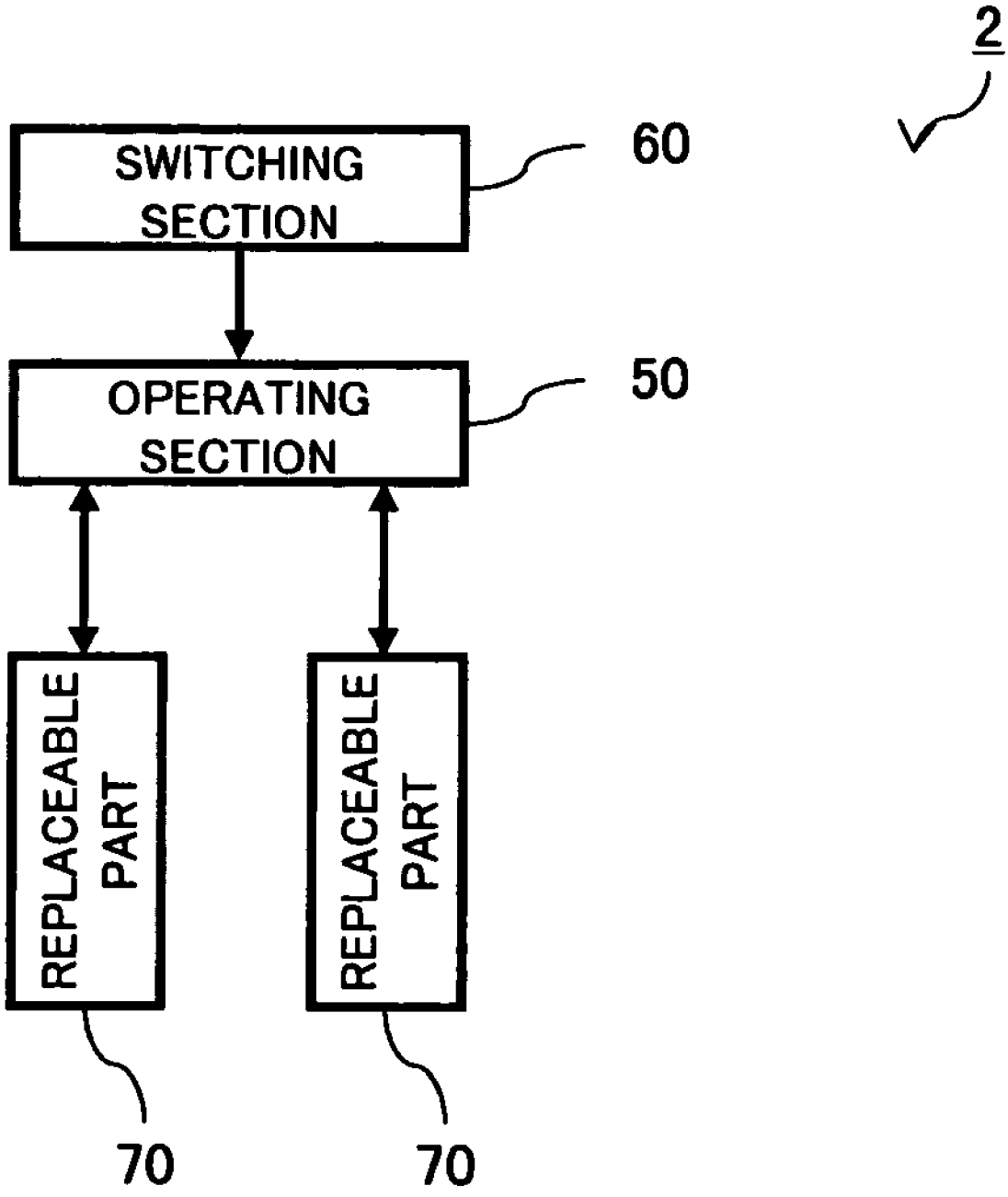
FIG. 5 is a block diagram showing a schematic structure of a part detachable device.

FIG. 5 is a block diagram showing a schematic structure of a part detachable device 2. As shown in FIG. 5, the part detachable device 2 includes an operating section 50 to which a replaceable part 70 is detachably attached and a switching section 60 for switching the operation mode of the operating section 50 between an approved part mode corresponding to a case wherein an approved part is attached to the operating section as the replaceable part 70 and an unapproved part mode corresponding to a case that a product other than the approved part is attached to the operating section. In the unapproved part mode, the operating section 50 maintains a minimum functionality as the device and restricts functions realized by the approved part mode. Here, the minimum functionality as the device indicates the basic function provided by use of the device. The minimum function includes, for example, a function for receiving and displaying an image in the case of a television, a function for recording and reproducing information in the case of a hard disk recorder, and a speaking function in the case of a fixed telephone. The structure and operation of the part detachable device 2 are the same as those of the image forming apparatus 1 according to the above-described embodiment.

Second Embodiment

Figures 6A, 6B:
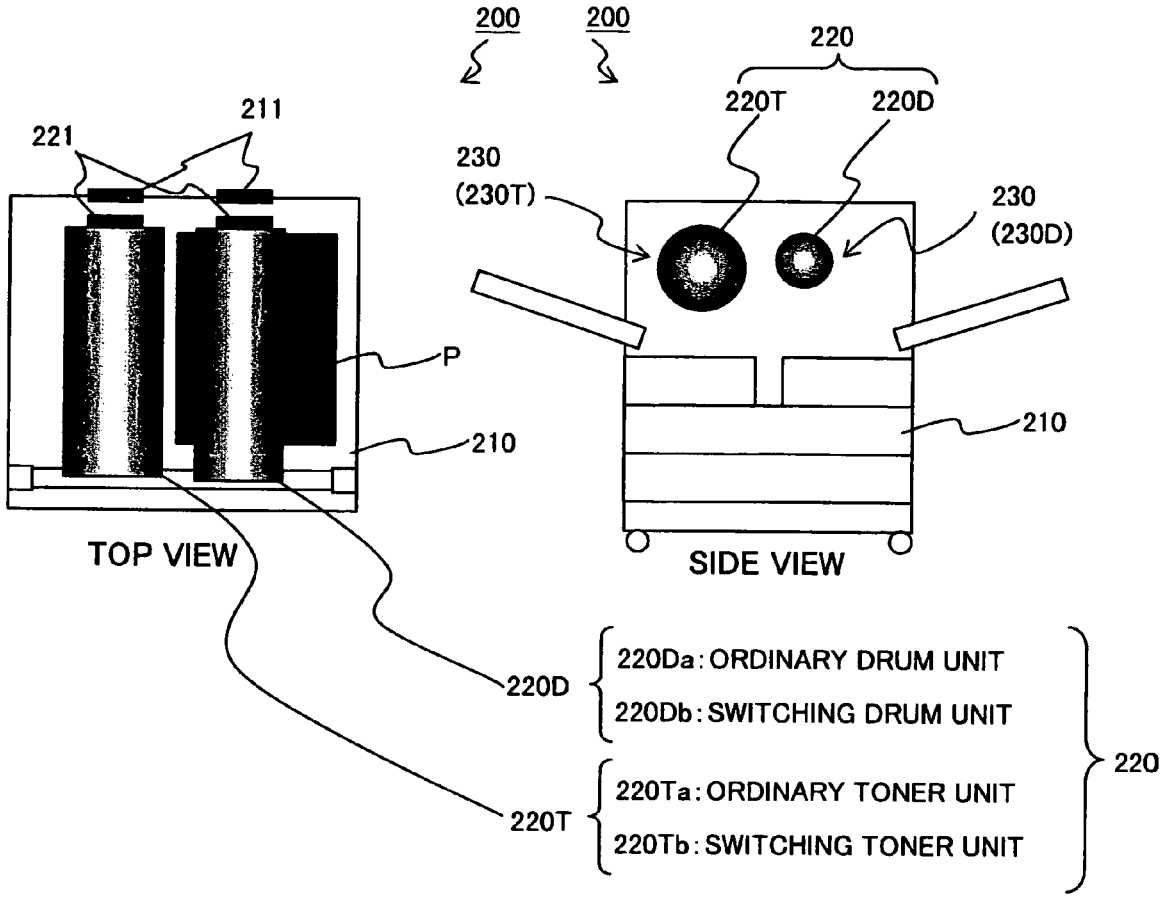
FIG. 6A is a top view showing a schematic structure of an image forming apparatus according to a second embodiment of the present invention.
FIG. 6B is a side view showing a schematic structure of the image forming apparatus according to the second embodiment of the present invention.

FIGS. 6A and 6B are a top view and a side view respectively showing the schematic structures of an image forming apparatus 200 according to a second embodiment. The image forming apparatus 200 is an apparatus for forming an image on a recording medium P such as a sheet as in a copying machine, a printer, a facsimile device, or the like. In this embodiment, as a printing system, an electro-photographic system is described as an example. However, the printing system may be another system such as an ink jet system.

In FIGS. 6A and 6B, the image forming apparatus 200 includes an image forming apparatus main body 210 (refer it to as an apparatus main body, hereinafter) and a replaceable part 220 detachably attached to the apparatus main body 210. The apparatus main body 210 forms an image on a recording medium by using the replaceable part 220.

The apparatus main body 210 is a substantially fixed component of the image forming apparatus 200. The apparatus main body 210 has an attaching section 230 to which the replaceable parts 220 are attachable. The replaceable part 220 is ordinarily a part which can be suitably replaced by another part when the part is exhausted. In FIGS. 6A and 6B, as the replaceable part 220, a toner unit 220T with which toner to be supplied is filled and a drum unit 220D in which a photosensitive drum, an charging device, and a cleaner are integrally formed are shown. The toner unit 220T and the drum unit 220D are respectively attached to attaching sections 230T and 230D to be attached. The number of the replaceable parts 220 may be one or three or more. The types of the replaceable parts 220 are not limited to specific types.

A manufacturer of the apparatus main body 210 ordinarily assumes that the replaceable parts 220 (an approved part) whose use is permitted by the manufacturer, such as a genuine part or a recommended part, is attached to the apparatus main body and designs and produces the apparatus main body 210 so as to obtain desired image quality and a safety performance based on that condition. When the replaceable part 220 (an unapproved part) whose use is not permitted by the manufacturer, such as a knock-off or unlicensed copy, etc. is attached to the apparatus main body 210 designed and produced as described above, an operation in this case is outside the range of an assumption of the manufacturer. Accordingly, various disadvantages may arise. For example, a problem concerning image quality, a malfunction, a failure of the apparatus main body 210, or tearing or wrinkling of the paper may occur.

In order to avoid the above-described disadvantages, many image forming apparatuses determine whether or not an attached replaceable part is an approved part. When the replaceable parts is not an approved part, the image forming operation is inhibited. However, some users still desire to use the unapproved part. Thus, in this embodiment, as an operation mode of the apparatus main body 210, not only an inhibiting mode for inhibiting the use of the unapproved part, but also a permitting mode for permitting the use of the unapproved part is provided. In the permitting mode, in order to satisfy the desire of a user who wishes to use the unapproved part, while an image forming function is maintained, the functions of the image forming apparatus are restricted to avoid the disadvantages due to the use of the unapproved part. The contents of the inhibiting mode and the permitting mode will be described below.

When the fact that the use of the unapproved part causes disadvantages and the functions are restricted in the authorized mode is taken into consideration, it is undesirable that the user easily switches the inhibiting mode and the permitting mode. However, if a service engineer performs a switching operation, this will be inconvenient for the user and may increase costs to the manufacturer or seller as described above.

Thus, in this embodiment, the inhibiting mode and the permitting mode are switched by the operation of attaching the replaceable parts 220. That is, the replaceable part 220 is employed as a tool for switching the operation mode. Specifically, as the replaceable part 220, at least two types of replaceable parts including an ordinary replaceable part 220*a* and a switching replaceable part 220*b* for storing operation mode switching information are provided. Then, when the switching replaceable part 220*b* is attached to the apparatus main body, the apparatus main body 210 switches the operation mode in accordance with the operation mode switching information held by the replaceable part 220*b*. On the other hand, when the ordinary replaceable part 220*a* is attached to the apparatus main body, the apparatus main body does not switch the operation mode and maintains a current operation mode.

Next, the structure and operation of the image forming apparatus 200 will be more specifically described.

Figure 7:
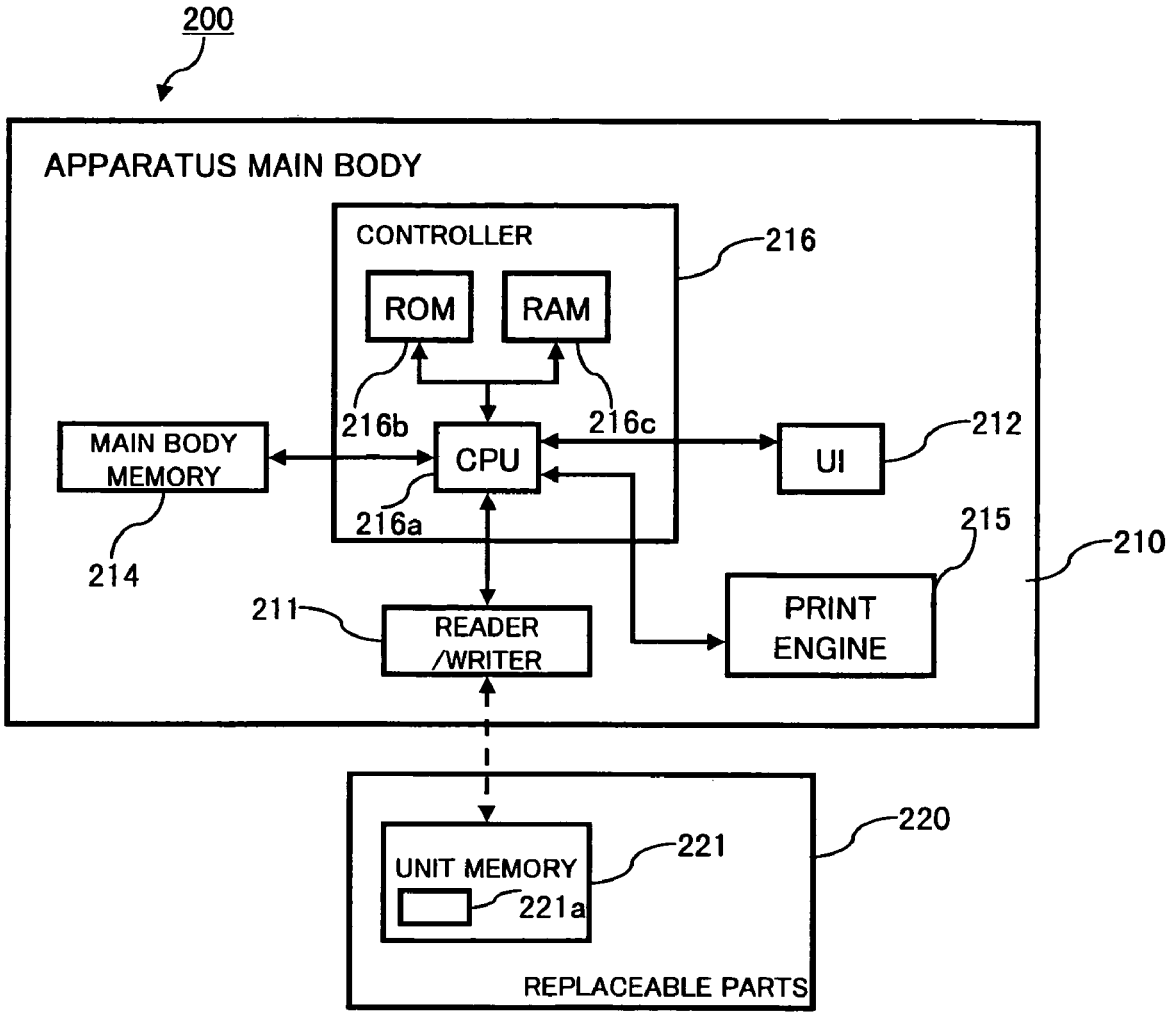
FIG. 7 is a block diagram showing the structure of the image forming apparatus according to the second embodiment of the present invention.

FIG. 7 is a block diagram showing the structure of the image forming apparatus 200 according to this embodiment. In FIG. 7, to the replaceable parts 220, a unit memory 221 is provided as a nonvolatile storing medium. In the switching replaceable parts 220*b*, the operation mode switching information for switching the operation mode of the apparatus main body 210 is stored in a prescribed storing area 221*a* of the unit memory 221. The operation mode switching information may include information showing to which of multiple operation modes the operation mode is to be switched. On the other hand, in the ordinary replaceable parts 220*a*, information showing no switching is stored in the prescribed storing area 221*a* of the unit memory 221. The unit memory 221 preferably also serves as a memory for storing control information such as a correction value of unevenness in production or a using history. Here, the unit memory 221 is a semiconductor memory included in an RFID (Radio Frequency Identification) tag to which data is read and from which data is written using waves. The unit memory 221 may be another type of storing medium such as a magnetic memory or an optical memory. Further, the unit memory 221 may be accessed by wire.

The operation mode switching information is preferably written in the unit memory 221 by a special jig, a tool, or a writer to prevent the switching replaceable parts 220*b* from being copied or tampered with.

The apparatus main body 210 includes a reader/writer 211, a user interface (UI) 212, a main body memory 214, a print engine 215, and a controller 216.

The reader/writer 211 is a communication module for reading and writing information relative to the unit memory 221. As shown in FIG. 6A, the reader/writer 211 is disposed near the RFID tag including the unit memory 221 and serves as a coupler for communicating with the unit memory 221 under non-contact therewith. When multiple replaceable parts 220 are attached to the apparatus main body, the reader/writer 211 is provided for each of the replaceable parts 220. It should be understood that one reader/writer 211 may be configured to correspond to two or more replaceable parts 220.

The UI 212 is an interface for displaying various types of information and receiving an input operation from a user. For example, a display, an operating button, a touch panel type control panel, etc. may be provided.

The main body memory 214 is a storing medium for holding various types of information including information, referred to as "operation mode information" hereinafter, indicating the current operation mode and is a rewritable nonvolatile memory such as an NVRAM (Non-Volatile RAM).

The print engine 215 is a device for printing an image on the recording medium P in accordance with an electrophotographic process and includes a laser scanning optical system (ROS: Raster Output Scanner), a transfer device, a fixing device, various types of motors and a power circuit for applying a bias or supplying electric power to these devices or replaceable parts 220.

The controller 216 controls the overall operation of the image forming apparatus 200 and functions as an operation mode switching section for switching the operation mode.

Here, the controller 216 is a circuit board on which a CPU 216*a*, a ROM 216*b*, and a RAM 216*c* are mounted. A function for controlling the entire part of the image forming apparatus 200 or a function as the operation mode switching section is realized by executing a program stored in a storing medium such as the ROM 216*b* by the CPU 216*a*. Methods for realizing the above-described functions are not limited to specific methods. For example, the functions may be respectively realized by, for example, specialized hardware.

Next, an example of operation of the image forming apparatus 200 having the above-described structure will be described in detail. Because general image forming operation of the image forming apparatus 200 is widely known, explanation of such will be omitted.

Figure 8:
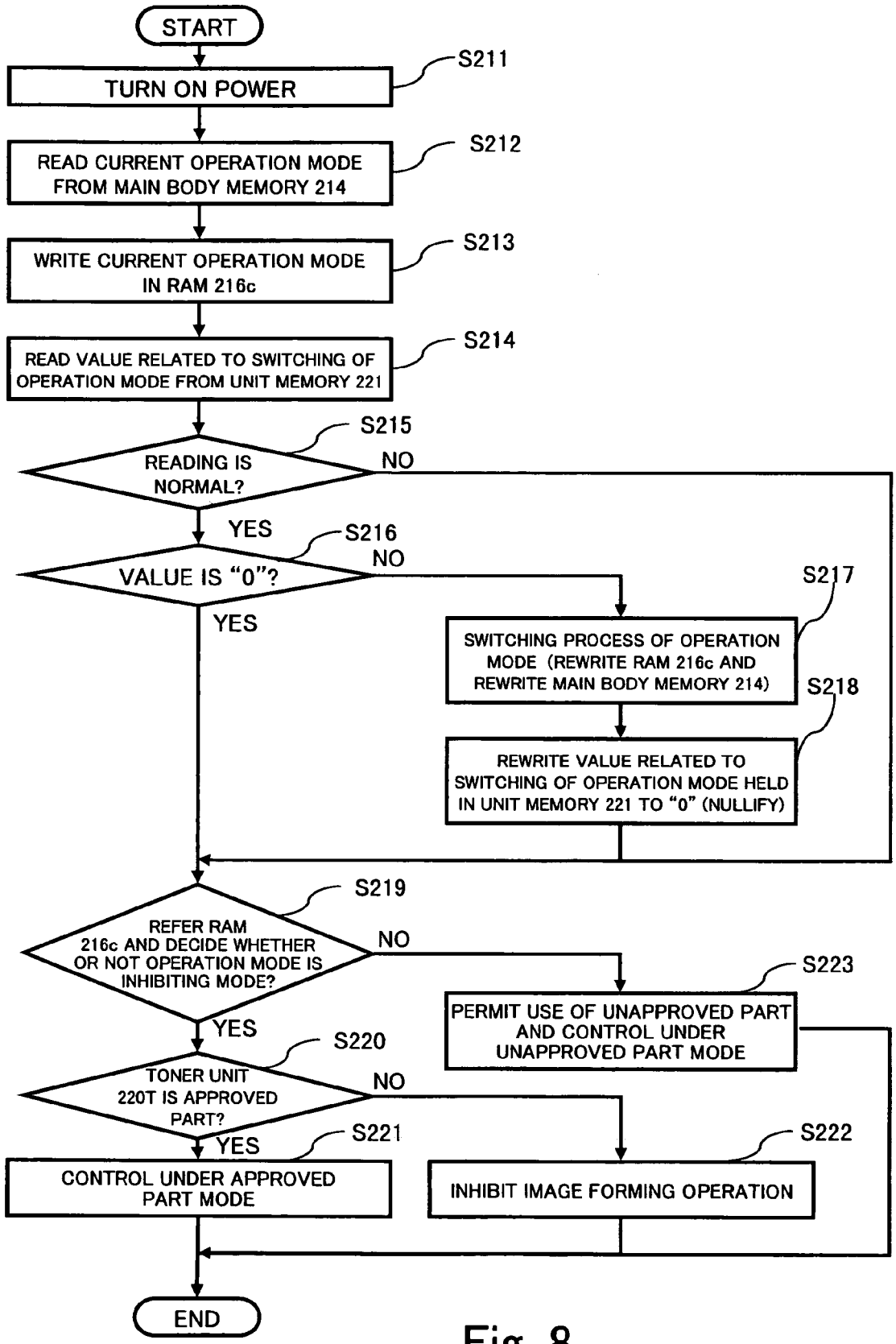
FIG. 8 is a flowchart showing an operational procedure of the image forming apparatus according to the second embodiment of the present invention.

FIG. 8 is a flowchart showing an operation procedure of the image forming apparatus 200 according to this embodiment. In this embodiment, for switching the operation mode, the toner unit 220T is used. Accordingly, in the toner unit 220T, two types of toner units are provided, an ordinary toner unit 220Ta as the ordinary replaceable part 220*a* and a switching toner unit 220Tb as the switching replaceable part 220*b*. In the storing area 221*a* of the unit memory 221 of the ordinary toner unit 220Ta, a value "0" is stored as the information showing no switching. In the storing area 221*a* of the unit memory 221 of the switching toner unit 220Tb, a value "1" showing that the operation mode is to be switched to the permitting mode or a value "2" showing that the operation mode is to be switched to the inhibiting mode is stored as the operation mode switching information.

When the power of the image forming apparatus 200 is turned on (S211), the CPU 216*a* reads the operation mode information (the "inhibiting mode" or the "permitting mode") showing the current operation mode from the main body memory 214 (S212) and writes the read operation mode information in the RAM 216*c* (S213).

Then, the CPU 216*a* reads the value held in the storing area 221*a* of the unit memory 221 of the toner unit 220T through the reader/writer 211 (S214). When the value cannot be normally read (S215: NO), a process related to the switching operation of the operation mode cannot be carried out. Thus, the CPU 216*a* moves to step S219. As a reason why the value cannot be properly read, for example, the toner unit 220T may be possibly the unapproved part or a failure of a communication system may be exemplified. When the value is properly read (S215: YES), the CPU 216*a* decides whether or not the read value is "0" (S216).

When the CPU 216*a* decides that the read value is "0" (S216: YES), that is, when the ordinary toner unit 220Ta is attached to the apparatus main body, the CPU 216*a* moves to the step S219. In this case, the operation mode is not switched and the current operation mode is maintained.

On the other hand, when CPU 216*a* decides that the read value is not "0" (S216: NO), that is, when the switching toner unit 220Tb is attached to the apparatus main body, the CPU 216*a* switches the operation mode in accordance with the read value (S217). Specifically, when the read value is "1", the CPU 216*a* rewrites the operation mode information held by the RAM 216*c* and the main body memory 214 to the "permitting mode". Thus, when the "inhibiting mode" is held in the main body memory 214, the inhibiting mode is switched to the permitting mode. When the "permitting mode" is held in the main body memory 214, consequently, the operation mode is not switched. Further, when the read value is "2", the CPU 216*a* rewrites the operation mode information held by the RAM 216*c* and the main body memory 214 to the "inhibiting mode". Thus, when the "permitting mode" is held in the main body memory 214, the permitting mode is switched to the inhibiting mode. When the "inhibiting mode" is held in the main body memory 214, consequently, the operation mode is not switched.

When the switching process of the operation mode is finished, the CPU 216*a* performs a process for nullifying the operation mode switching information held in the toner unit 220T (S218). Specifically, the CPU 216*a* rewrites the value held in the prescribed storing area 221*a* of the unit memory 221 to "0" through the reader/writer 211. In this process, the number of switches of the operation mode by a certain switching toner unit 220Tb is limited to one time. That is, the switching toner unit 220Tb is used only once to switch the operation mode. Thus, when a certain toner unit 220T is used for multiple apparatus main bodies 210, the operation mode can be prevented from being unexpectedly switched, that is, an erroneous operation can be prevented. Here, the number of times of uses is limited to one time, however, may be limited to a prescribed number of plurality of times. In this case, the number of times of uses is written in, for example, the unit memory 221. When the number of times of uses reaches a prescribed number of times, the value of the storing area 221*a* may be set to "0". Further, the number of times of uses is not necessarily limited and the step S218 may be omitted.

In step S219, the CPU 216*a* refers to the operation mode information held in the RAM 216*c* to decide whether or not the operation mode information is the "inhibiting mode".

When the CPU 216*a* decides that the operation mode information is the inhibiting mode (S219: YES), the CPU 216*a* determines whether or not an attached toner unit 220T is the approved part in accordance with a prescribed determining method (S220). Specifically, the CPU 216*a* obtains information showing whether or not the toner unit 220T is the approved part from the toner unit 220T and determines whether or not the toner unit 220T is the approved part on the basis of the obtained information. For example, the CPU 216*a* reads encoded information previously stored in the unit memory 221 to discriminate whether or not the toner unit 220T is the approved part depending on whether or not the encoded information can be precisely decoded. In this case, the information showing whether or not the toner unit 220T is the approved part may be other information such as a hologram, not shown, attached to the toner unit 220T or the physical characteristic value of the toner unit 220T. Further, the method for determining whether or not the toner unit 220T is the approved part is not limited to a specific method.

When it is determined that the toner unit 220T is the approved part (S220: YES), the CPU 216*a* controls the image forming apparatus 200 so as to operate under a preset approved part mode (S221). Here, the approved part mode in this embodiment is a control mode corresponding to a case that the approved part is attached to the apparatus main body as the toner unit 220T as in the first embodiment. In the approved part mode, all functions of the image forming apparatus 200 can be realized.

On the other hand, when it is discriminated that the toner unit 220T is not the approved part (S220: NO), the CPU 216*a* inhibits an image forming operation by the image forming apparatus 200 in order to avoid the disadvantages due to the use of the unapproved part (S222). At this time, to inform the user of a reason why an image forming function is stopped, the CPU 216*a* preferably displays on the display of the UI 212 that the toner unit 220T as the unapproved part is attached to the apparatus main body.

In the step S219, when the CPU 216*a* decides that the operation mode information is not the inhibiting mode (S219: NO), that is, the permitting mode, the CPU 216*a* controls the image forming apparatus 200 so as to operate under a preset unapproved part mode whether the attached toner unit 220T is the approved part or not (S223). Here, the unapproved part mode in this embodiment is a control mode corresponding to a case that the unapproved part is attached to the apparatus main body as the toner unit 220T as in the first embodiment. In the unapproved part mode, to satisfy the desire of the user who wishes to use the unapproved part, while the image forming function of the image forming apparatus 200 is maintained, the functions of the image forming apparatus 200 realized in the approved part mode are restricted to avoid the disadvantages due to the use of the unapproved part.

Here, in the permitting mode, the image forming apparatus is controlled under the unapproved part mode whether the attached toner unit 220T is the approved part or not. However, a below-described process may be carried out. That is, whether or not the attached toner unit 220T is the approved part may be discriminated, and when the toner unit is the approved part, the image forming apparatus may be controlled under the approved part mode and when the toner unit is the unapproved part, the image forming apparatus may be controlled under the unapproved part mode.

Next, specific examples of the unapproved part mode will be compared with the approved part mode and described. Here, the specific examples are classified into 1 to 4 and explained. These examples may be suitably combined together.

Unapproved Part Mode Example 1

In the approved part mode, in order to correct an unevenness in production or maintain an image quality, the CPU 216*a* obtains the attribute information of the replaceable parts from the replaceable parts 220 to control the print engine 215 on the basis of the attribute information. For example, the CPU 216*a* reads control information (a correction value or a counter value, etc.) from the unit memory 221 to determine various types of voltage, electric current, temperature, etc. for forming an image on the basis of the control information. As the attribute information of the replaceable parts 220, for example, bar code information attached to the replaceable parts 220 and the physical characteristic value of the replaceable parts 220 are exemplified as well as the control information stored in the unit memory 221.

When a certain replaceable part 220 is an unapproved part, improper information may be possibly written in the unit memory 221 of the replaceable parts 220. Further, the physical characteristics of the replaceable part 220 may be different from those of the approved part. Accordingly, attribute information obtained from the replaceable part 220 as the unapproved part may be absolutely different from that of the approved part. When the attribute information is employed for controlling the print engine 215, a disadvantage such as a failure may probably arise.

Thus, in the unapproved part mode, the CPU 216*a* controls the print engine 215 on the basis of information previously held in the apparatus main body 210 in place of the attribute information obtained from the replaceable part 220.

Unapproved Part Mode Example 2

In the approved part mode, the CPU 216*a* obtains the attribute information of the replaceable parts from the replaceable part 220 to realize prescribed functions by using the attribute information. For example, residual quantity information of toner is read from the unit memory 221 of the toner unit 220T to display a residual quantity of toner on the display of the UI 212 by using the residual quantity information of toner.

When the toner unit 220T is the unapproved part, incorrect information may be possibly written in the unit memory 221. Therefore, when the residual quantity information of toner is read from the toner unit 220T of the unapproved part to display the residual quantity of toner on the basis thereof, incorrect information may be provided to the user.

Thus, in the unapproved part mode, the CPU 216*a* stops the prescribed functions realized by using the attribute information obtained from the replaceable part 220, such as a function for displaying the residual quantity of toner. The above-described prescribed function is not limited to the function for displaying the residual quantity of toner.

Unapproved Part Mode Example 3

The approved part mode is set so that a prescribed quantity is obtained when the approved part is attached to the apparatus main body as the replaceable parts 220. Specifically, various of parameters such as voltage, electric current, temperature, etc. in the approved part mode are set on the assumption that the replaceable part 220 satisfies prescribed characteristics (for example, withstand voltage, incombustibility, wear performance, etc.) as the approved part.

It is, however, unclear whether the above-described prescribed characteristics are satisfied in the unapproved part. Accordingly, when the unapproved part is attached to the apparatus main body and operating parameters of the approved part mode are applied to the unapproved part, problems such as discharge, increased temperature, wearing out of components, and the like may arise.

Thus, in the unapproved part mode, the CPU 216*a* controls the print engine 215 so as to operate within an operation restricted range more strict than that of the approved part mode. For example, upper limits and lower limits more strict than those of the approved part mode are set to various output values such as voltage, electric current, temperature, etc.

Unapproved Part Mode Example 4

As explained in the above-described specific examples 1 to 3, the operation of the image forming apparatus 200 differs between the approved part mode and the unapproved part mode. Accordingly, the user may erroneously recognize the operation at the time of the unapproved part mode to be a failure of the image forming apparatus 200.

Thus, in the unapproved part mode, the CPU 216*a* informs the user that the current operation mode is the unapproved part mode. For example, the fact that the current operation mode is the unapproved part mode may be displayed on the display of the UI 212.

As described above, according to this embodiment, the operation mode of the apparatus main body 210 is switched by attaching the replaceable parts 220. Thus, a person having no special knowledge can simply switch the operation mode. Further, the operation mode can be switched by the same operation as an operation for replacing the ordinary replaceable parts 220*a* by another replaceable parts and a complicated operation is not required, an erroneous operation by the user can be prevented. On the other hand, when the user tries to switch the operation mode, the user must get the switching replaceable parts 220*b* from the manufacturer or the seller. Therefore, the degree of freedom for switching the operation mode by the user can be more restricted than when the operation mode is switched by the operation of the UI 212. That is, this embodiment is preferably employed when a free switching operation by the user is not preferable. When the user desires to switch the operation mode, the manufacturer or the seller may deliver the switching replaceable parts 220*b* to the user. Therefore, a service man need not be dispatched to a place where the apparatus main body 210 is installed. Thus, a cost can be reduced. Further, when the manufacturer or the seller delivers the switching replaceable parts 220*b* to the user, the manufacturer or seller can explain the user about the disadvantages or noticed items (for example, disadvantages due to the use of the unapproved part) due to the switching of the operation mode.

Further, as the replaceable part 220, two types of replaceable parts, including the switching replaceable parts 220*b* in which the operation mode switching information is stored and the ordinary replaceable part 220*a* that does not hold such information, are provided. When the switching replaceable part 220*b* is attached to the apparatus main body 210, the operation mode is switched. When the ordinary replaceable part 220*a* is attached to the apparatus main body, the operation mode is not switched. Accordingly, when the ordinary replaceable part 220*a* is used, the operation mode is not switched. Thus, the operation mode can be prevented from being unexpectedly switched.

For switching the operation mode, because the number of uses of the switching replaceable part 220*b* is limited to one time, when one switching replaceable part 220*b* is used for multiple apparatus main bodies 210, unexpected switching of the operation mode, that is, an erroneous operation, can be prevented.

Third Embodiment

Figure 9:
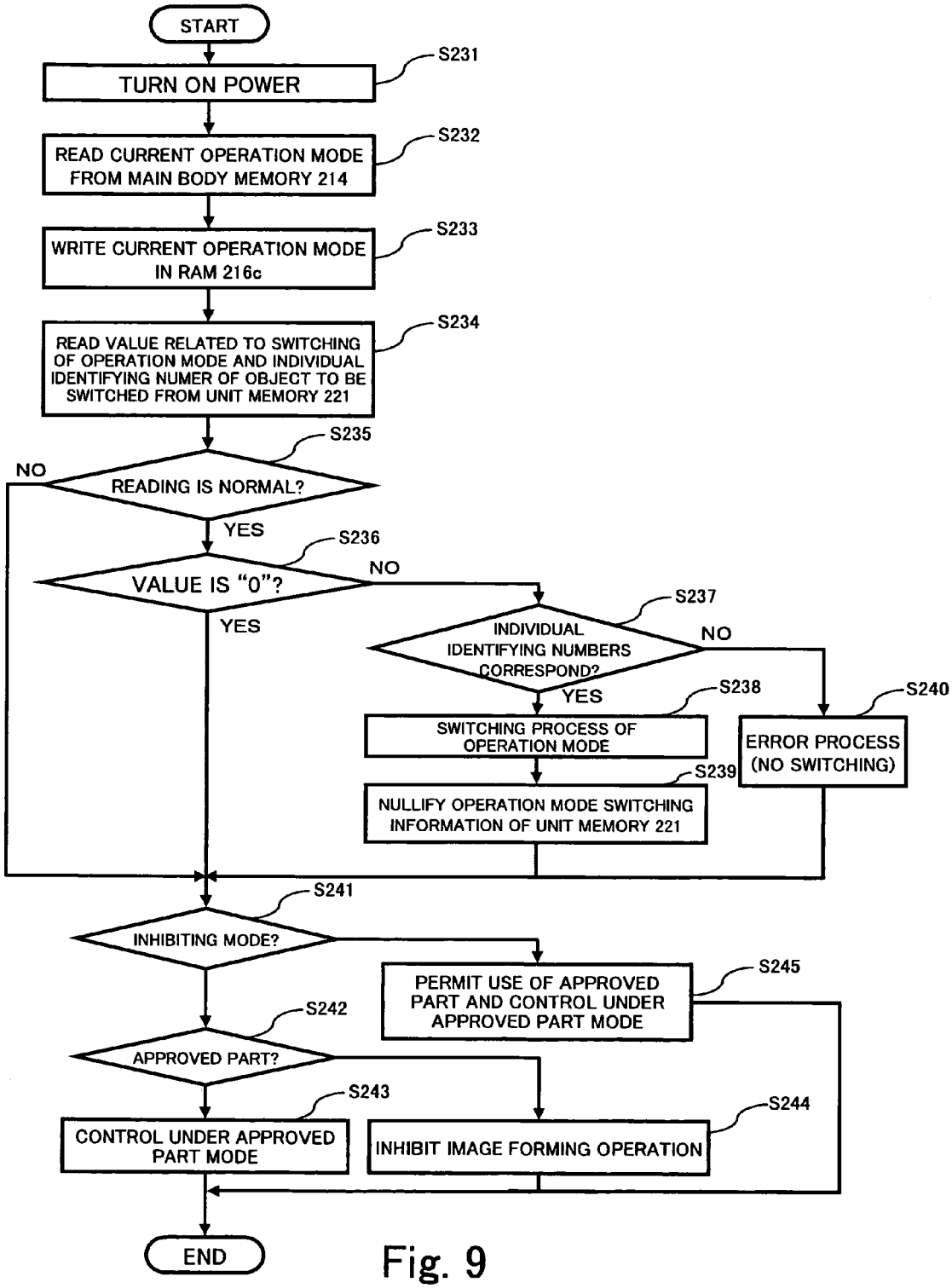
FIG. 9 is a flowchart showing an operational procedure of an image forming apparatus according to a third embodiment of the present invention.

FIG. 9 is a flowchart showing an operation procedure of an image forming apparatus 300 according to a third embodiment of the present invention. Because this embodiment is substantially the same as the second embodiment, to avoid duplication of description, components common to those of the second embodiment are designated using the same reference numerals and their description is not repeated.

In this embodiment, individual identifying information for identifying an apparatus main body 210 is assigned to the apparatus main body 210. Specifically, an individual identifying number of the apparatus main body 210 is pre-stored in a ROM 216*b* of a controller 216 of the apparatus main body 210. In the unit memory 221 of a switching replaceable part 220*b*, the individual identifying number of the apparatus main body 210 whose operation mode is to be switched is previously held together with operation mode switching information. Here, the individual identifying number is held in a prescribed storing area 221*b* of the unit memory 221.

Here, the individual identifying information is preferably written in the unit memory 221 by a special jig, a tool or a writer to prevent the switching replaceable part 220*b* from being copied or tampered with.

When the power of the image forming apparatus 300 is turned on (S231), a CPU 216*a* reads operation mode information (an "inhibiting mode" or a "permitting mode") showing a current operation mode from a main body memory 214 (S232) and writes the read operation mode information in a RAM 216*c* (S233).

Then, the CPU 216*a* reads the individual identifying number held in the storing area 221*b* as well as a value held in a storing area 221*a* of the unit memory 221 of a toner unit 220T (S234).

When a reading operation is normally carried out (S235: YES) and the read value is not "0" (S236: NO), that is, when a switching toner unit 220Tb is attached to the apparatus main body, the CPU 216*a* decides whether or not the individual identifying number read from the storing area 221*b* of the unit memory 221 corresponds to the individual identifying number held in the ROM 216*b* (S237). That is, the CPU 216*a* decides whether or not the switching toner unit 220Tb attached to the apparatus main body 210 is a toner unit for the apparatus main body 210.

Then, when the CPU 216*a* decides that the individual identifying numbers correspond to each other (S237: YES), the CPU 216*a* performs a switching process of the operation mode (S238). On the other hand, when the CPU 216*a* decides that the individual identifying numbers do not correspond to each other (S237: NO), the CPU 216*a* performs a prescribed error process, for example, the CPU 216*a* displays on the display of a UI 212 that the individual identifying numbers do not correspond to each other (S240), and then, moves to step S241. In this case, the operation mode is not switched and the current operation mode is maintained. Subsequent steps S241 to 245 are the same as the steps S219 to 223 in FIG. 8.

In this embodiment, for example, a user A who desires to switch the operation mode from the inhibiting mode to the permitting mode communicates this desire to switch the operation mode to the manufacturer, submitting an individual identifying number #A of an apparatus main body 210A. In accordance with this application, the manufacturer writes the individual identifying number #A in the storing area 221*b* of the switching toner unit 220Tb, and then, sends the switching toner unit 220Tb to the user A. The user A attaches the received toner unit 220Tb to the apparatus main body 210A and turns on a power. Then, the operation mode of the apparatus main body 210A is switched from the inhibiting mode to the permitting mode. However, when the user A or another user B attaches the toner unit 220Tb to another apparatus main body 210B, since the individual identifying numbers do not correspond to each other, the operation mode is not switched.

As described above, in this embodiment, when the individual identifying number of the apparatus main body 210 whose operation mode is to be switched that previously stored in the switching replaceable part 220*b* corresponds to the individual identifying number of the apparatus main body 210, the operation mode is switched. Thus, the apparatus main body 210 whose operation mode is switched by a certain switching replaceable parts 220*b* can be limited. Thus, in the apparatus main body 210, the operation mode can be prevented from being unexpectedly switched. Further, the manufacturer or seller can ascertain and manage each of the operation modes of multiple apparatus main bodies 210.

Fourth Embodiment

Figure 10:
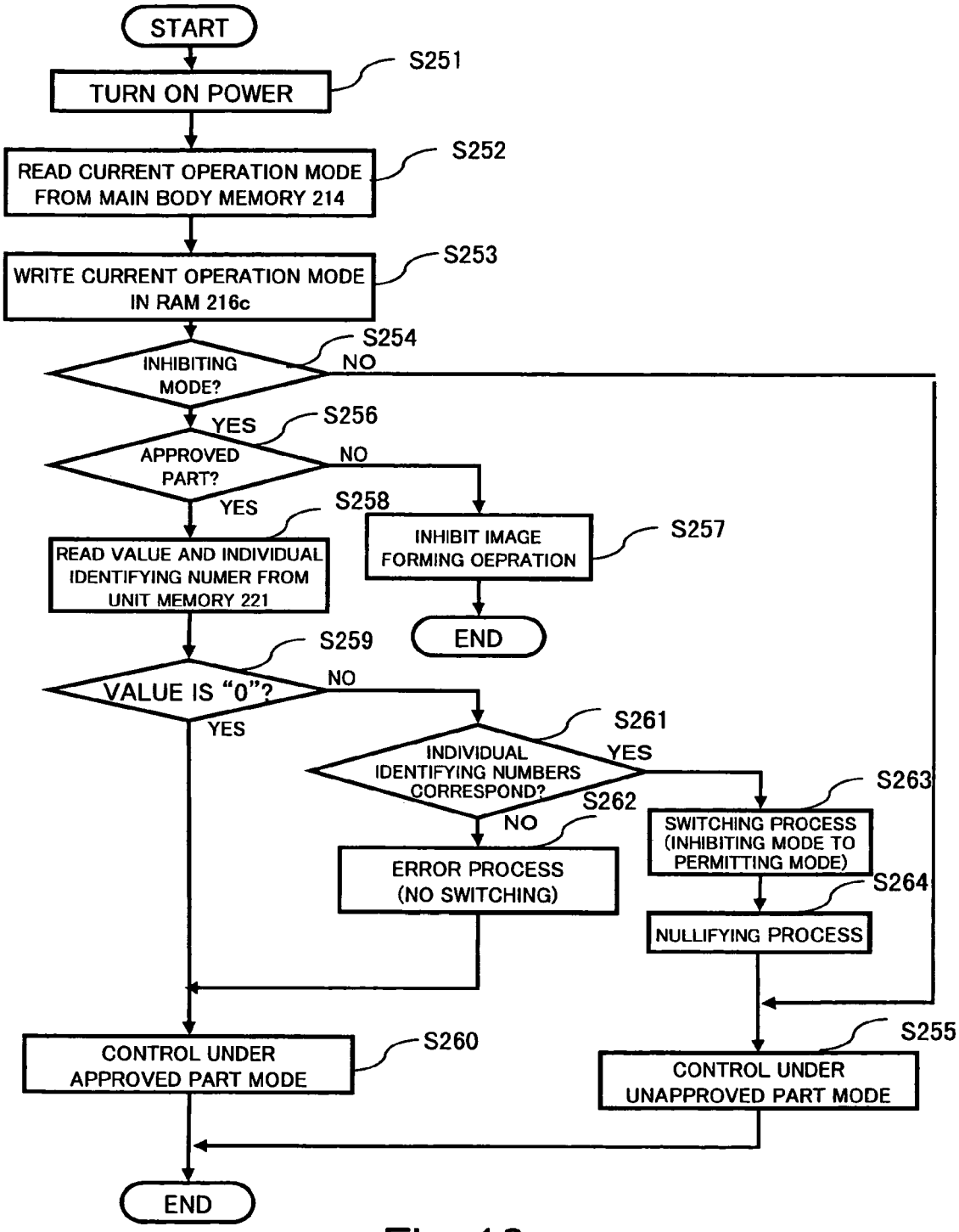
FIG. 10 is a flowchart showing an operational procedure of an image forming apparatus according to a fourth embodiment of the present invention.

FIG. 10 is a flowchart showing an operational procedure of an image forming apparatus 400 according to a fourth embodiment of the present invention. In this embodiment, to perform a process at high speed or reduce consumed power, when the current operation mode is the permitting mode, communication with a unit memory 221 is not performed. To avoid duplication of description, parts common to those of the second or the third embodiment are designated by the same reference numerals and explanation thereof is not repeated.

In this embodiment, in the permitting mode, a CPU 216*a* does not communicate with the unit memory 221. Accordingly, the permitting mode is not switched to an inhibiting mode by a switching toner unit 220Tb and switched by, for example, a service engineer. Thus, in this embodiment, in the storing area 221*a* of the unit memory 221 of the switching toner unit 220Tb, a value "1" showing that an operation mode is to be switched to the permitting mode is stored as operation mode switching information. Conversely, there is no toner unit 220T having the storing area 221*a* in which a value "2" showing that the operation mode is to be switched to the inhibiting mode.

When power of the image forming apparatus 400 is turned on (S251), the CPU 216*a* reads operation mode information (the "inhibiting mode" or the "permitting mode") showing the current operation mode from a main body memory 214 (S252) and writes the read operation mode information in a RAM 216*c* (S253).

Then, the CPU 216*a* refers to the operation mode information held in the RAM 216*c* to decide whether or not the current operation mode is the inhibiting mode (S254).

When the current operation mode is not the inhibiting mode (S254: NO), that is, the permitting mode, the CPU 216*a* does not communicate with the toner unit 220T. Then, the CPU 216*a* controls the image forming apparatus 400 so as to operate under a preset unapproved part mode whether the attached toner unit 220T is an approved part or not (S255).

On the other hand, when the current operation mode is the inhibiting mode (S254: YES), the CPU 216*a* determines whether or not the attached toner unit 220T is the approved part in accordance with a prescribed determining method (S256).

When the toner unit 220T is discriminated to be not the approved part (S256: NO), the CPU 216*a* inhibits an image forming operation by the image forming apparatus 400 to avoid disadvantages due to the use of an unapproved part (S257). At this point, the CPU 216*a* preferably displays on the display of the UI 212 information indicating that the toner unit 220T of the unapproved part is attached to an apparatus main body to inform a user of the reason why the image forming function is stopped.

On the other hand, when it is determined that the toner unit 220T is the approved part (S256: YES), the CPU 216*a* reads a value held in the storing area 221*a* of the unit memory 221 of the toner unit 220T and individual identifying information held in a storing area 221*b* through a reader/writer 211 (S258). Then, the CPU 216*a* decides whether or not the read value is "0" (S259).

When it is determined that the read value is "0" (S259: YES), that is, an ordinary toner unit 220Ta is attached to the apparatus main body, the operation mode is not switched and the current operation mode is maintained. Accordingly, the CPU 216*a* controls the image forming apparatus 400 so as to operate under an approved part mode (S260).

On the other hand, when it is determined that the read value is not "0" (S259: NO), that is, when the switching toner unit 220Tb is attached to the apparatus main body, the CPU 216*a* decides whether or not an individual identifying number read from the storing area 221*b* of the unit memory 221 corresponds to an individual identifying number held in a ROM 216*b* (S261).

Then, when the CPU 216*a* decides that the individual identifying numbers do not correspond to each other (S261: NO), the CPU 216*a* does not switch the operation mode, performs a prescribed error process (S262) and controls the image forming apparatus 400 so as to operate under the approved part mode (S260).

On the other hand, when the CPU 216*a* decides that the individual identifying numbers correspond to each other (S261: YES), the CPU 216*a* switches the inhibiting mode to the permitting mode (S263) and performs a process for nullifying operation mode switching information held in the toner unit 220T (S264). Then, the CPU 216*a* controls the image forming apparatus 400 so as to operate under the unapproved part mode (S255).

As described above, the operational procedure for switching the operation mode of the apparatus main body 210 with the replaceable parts 220 is not limited to the operational procedure of the second or the third embodiment, and numerous variations may be considered.

Further, according to this embodiment, since the communication with the unit memory 221 is not performed in the permitting mode, the process can be carried out at high speed and the consumed power can be reduced.

Fifth Embodiment

Figure 11:
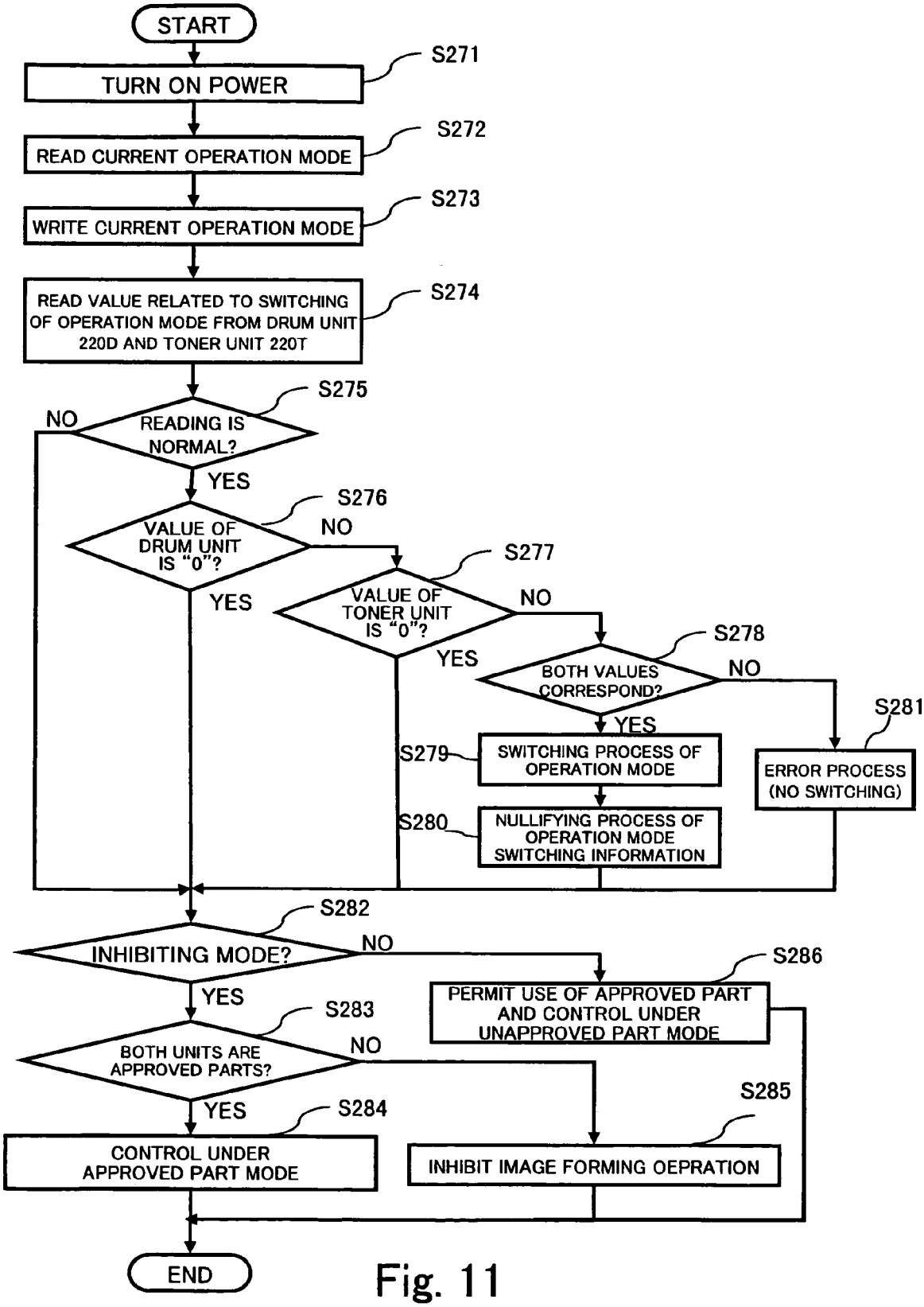
FIG. 11 is a flowchart showing an operational procedure of an image forming apparatus according to a fifth embodiment of the present invention;.

FIG. 11 is a flowchart showing an operational procedure of an image forming apparatus 500 according to a fifth embodiment of the present invention. Because this embodiment is substantially the same as the second embodiment, to avoid the duplication of description, parts common to those of the second embodiment are designated with the same reference numerals and their explanation will not be repeated.

In this embodiment, in multiple types of replaceable parts 220, at least two types of replaceable parts including ordinary replaceable parts 220*a* and switching replaceable parts 220*b* are provided. Then, when the multiple switching replaceable parts 220*b* are attached to an apparatus main body 210 with a prescribed combination, the apparatus main body 210 switches an operation mode. In other cases, the operation mode is not switched. In this example, the multiple types of replaceable parts 220 include a drum unit 220D and a toner unit 220T. When the drum unit 220D and the toner unit 220T are attached to the apparatus main body 210 at the same time, the operation mode is switched.

Accordingly, in the drum unit 220D, two types of units including an ordinary drum unit 220Da and a switching drum unit 220Db are provided. In the toner unit 220T, two types of units including an ordinary toner unit 220Ta and a switching toner unit 220Tb are provided. In the storing area 221*a* of each of unit memories 221 of the ordinary drum unit 220Da and the ordinary toner unit 220Ta, a value "0" is stored as information showing no switching. Further, in the storing area 221*a* of each of unit memories 221 of the switching drum unit 220Db and the switching toner unit 220Tb, a value "1" showing that an operation mode is to be switched to a permitting mode as operation mode switching information, or a value "2" showing that an operation mode is to be switched to an inhibiting mode is stored.

The multiple types of replaceable parts 220 is not limited to the above-described units and may be, for example, four types of toner units including cyan, magenta, yellow and black. When the multiple switching replaceable parts 220*b* are attached to the apparatus main body with the prescribed combination, the operation mode is switched. The multiple switching replaceable parts may include all of the multiple types of replaceable parts or a part of them. Further, as the prescribed combination, for example, a combination of cyan and magenta, or a combination of any three colors of four colors may be employed.

When the power of the image forming apparatus 500 is turned on (S271), a CPU 216*a* reads operation mode information (the "inhibiting mode" or the "permitting mode") showing a current operation mode from a main body memory 214 (S272) and writes the read operation mode information in a RAM 216*c* (S273).

Then, the CPU 216*a* reads the value held in the storing area 221*a* of each of the unit memories 221 of the drum unit 220D and the toner unit 220T (S274). When the CPU 216*a* cannot normally read the value (S275: NO), the CPU 216*a* cannot perform a process related to the switching of the operation mode, so that the CPU 216*a* moves to step S282. When the CPU 216*a* normally reads the value (S275: YES), the CPU 216*a* decides whether or not the value read from the drum unit 220D is "0" (S276).

When the value read from the drum unit 220D is "0" (S276: YES), that is, when the ordinary drum unit 220Da is attached to the apparatus main body, the CPU 216*a* moves to the step S282. In this case, the operation mode is not switched and the current operation mode is maintained.

On the other hand, when the value read from the drum unit 220D is not "0" (S276: NO), that is, when the switching drum unit 220Db is attached to the apparatus main body, the CPU 216*a* decides whether or not the value read from the toner unit 220T is "0" (S277).

When the value read from the toner unit 220T is "0" (S277: YES), that is, when the ordinary toner unit 220Ta is attached to the apparatus main body, the CPU 216*a* moves to the step S282. In this case, the operation mode is not switched and the current operation mode is maintained.

On the other hand, when the value read from the toner unit 220T is not "0" (S277: NO), that is, when the switching toner unit 220Tb is attached to the apparatus main body, the CPU 216*a* decides that the value read from the storing area 221*a* of the drum unit 220D corresponds to the value read from the storing area 221*a* of the toner unit 220T (S278).

When the CPU 216*a* decides that the values correspond to each other (S278: YES), the CPU 216*a* switches the operation mode in accordance with the read value like the step S217 shown in FIG. 8 (S279). Then, the CPU 216*a* performs a process for nullifying the operation mode switching information held in the drum unit 220D and the toner unit 220T like the step S218 shown in FIG. 8 (S280) and moves to the step S282.

On the other hand, when the CPU 216 decides that the values do not correspond to each other (S278: NO), the CPU 216*a* performs a prescribed error process, for example, the CPU 216*a* displays on a UI 212 that the values do not correspond to each other (S281) and moves to the step S282. In this case, the operation mode is not switched and the current operation mode is maintained.

In the step S282, the CPU 216*a* refers to the operation mode information held in the RAM 216*c* to decide whether or not the operation mode information is the "inhibiting mode" (S282).

When the CPU 216*a* decides that the operation mode information is the inhibiting mode (S282: YES), CPU 216*a* determines whether or not both the attached drum unit 220D and the toner unit 220T are approved parts in accordance with a prescribed discriminating method (S283).

When the CPU 216*a* determines that both the units are the approved parts (S283: YES), the CPU 216*a* controls the image forming apparatus 500 so as to operate under a preset approved part mode (S284). When the CPU 216*a* determines that at least one of the drum unit and the toner unit is not an approved part (S283: NO), the CPU 216*a* inhibits an image forming operation by the image forming apparatus 500 (S285).

When the CPU 216*a* decides that the operation mode information is not the inhibiting mode (S282: NO), that is, the operation mode information is the permitting mode, the CPU 216*a* controls the image forming apparatus 500 so as to operate under a preset unapproved part mode whether or not the attached drum unit 220D and the toner unit 220T are the approved parts (S286).

As described above, according to this embodiment, the ordinary replaceable parts 220*a* and the switching replaceable parts 220*b* are provided in the multiple types of replaceable parts 220. When the multiple switching replaceable parts 220*b* are attached to the apparatus main body with the prescribed combination, the operation mode is switched. Accordingly, a degree of freedom for switching the operation mode can be more restricted, and erroneous switching operation can be prevented with greater certainty. Here, by assuming that the operation mode is switched when the replaceable parts 220*b* for all of the multiple types of replaceable parts are attached to the apparatus main body, erroneous operation can be more reliably prevented. On the other hand, assuming that the operation mode is switched when a part of the replaceable parts 220*b* of the multiple types of replaceable parts is attached to the apparatus main body, the degree of freedom for switching the operation mode can be increased, and while the degree of freedom for switching the operation mode is restricted, the operation mode can be simply switched.

Sixth Embodiment

Figure 12:
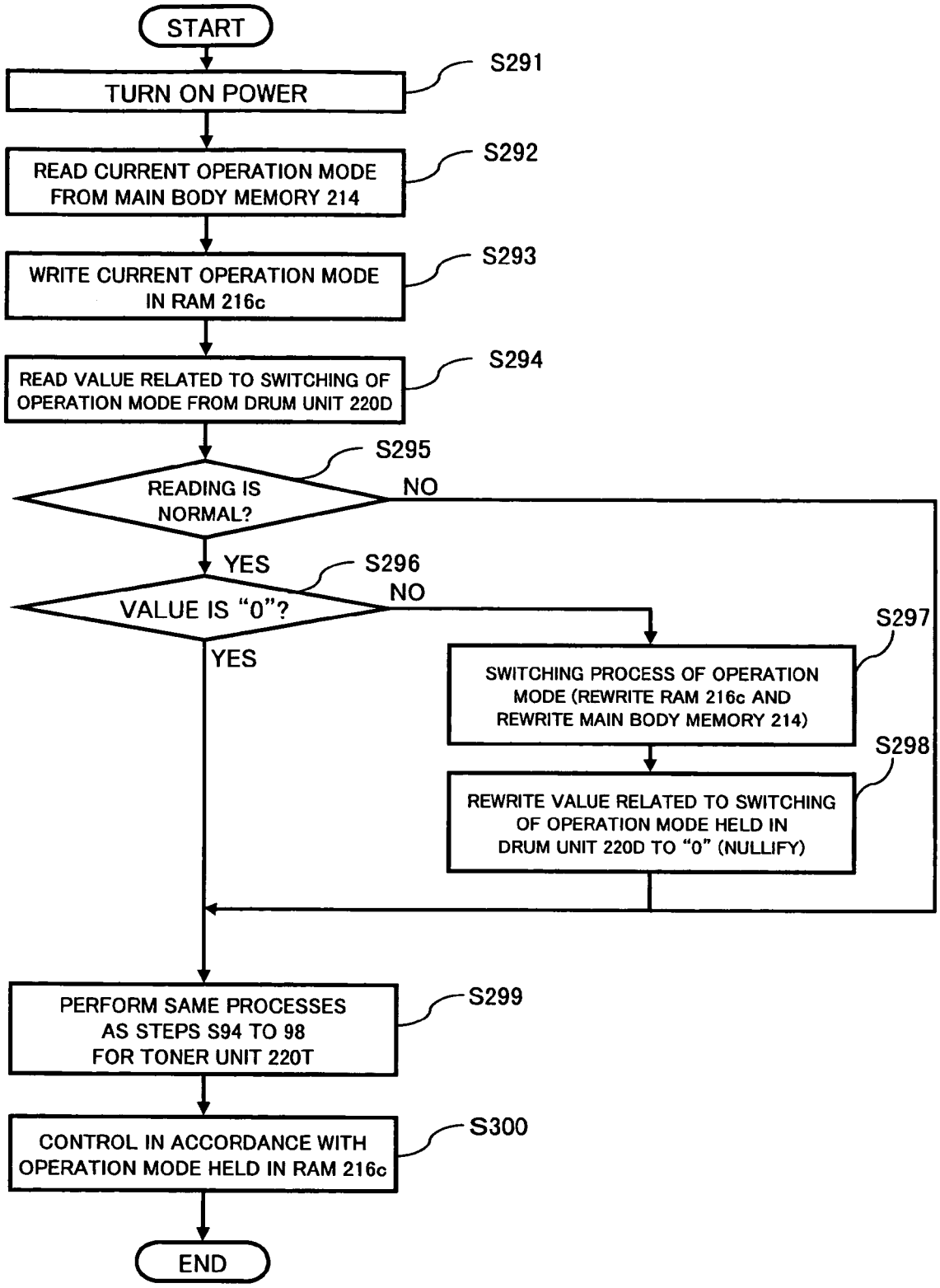
FIG. 12 is a flowchart showing an operational procedure of an image forming apparatus according to a sixth embodiment of the present invention.

FIG. 12 is a flowchart showing an operational procedure of an image forming apparatus 600 according to a sixth embodiment of the present invention. In the following description, to avoid the duplication of a description, parts common to the second to the fifth embodiments are designated by the same reference numerals and their explanation will not be repeated.

In this embodiment, an operation mode (an inhibiting mode or a permitting mode) is set for each of a drum unit 220D and a toner unit 220T. Accordingly, in the drum unit 220D, the operation mode is switched between a drum inhibiting mode for inhibiting the use of an unapproved part and a drum permitting mode for permitting the use of an unapproved part. Further, in the toner unit 220T, the operation mode is switched between a toner inhibiting mode for inhibiting the use of an unapproved part and a toner permitting mode for permitting the use of an unapproved part.

In the storing area 221*a* of a unit memory 221 of a switching drum unit 220Db, a value "1" showing that the operation mode is to be switched to the drum permitting mode, or a value "2" showing that the operation mode is to be switched to the drum inhibiting mode is stored. Further, in the storing area 221*a* of a unit memory 221 of a switching toner unit 220Tb, a value "1" showing that the operation mode is to be switched to the toner permitting mode, or a value "2" showing that the operation mode is to be switched to the toner inhibiting mode is stored.

In FIG. 12, when a power of the image forming apparatus 600 is turned on (S291), a CPU 216*a* reads operation mode information (the "drum inhibiting mode" or the "drum permitting mode", the "toner inhibiting mode" or the "toner permitting mode") showing a current operation mode from a main body memory 214 (S292) and writes the read operation mode information in a RAM 216*c* (S293).

Then, the CPU 216*a* reads a value held in the storing area 221*a* of the unit memory 221 of the drum unit 220D through a reader/writer 211 (S294). When the CPU 216*a* cannot normally read the value (S295: NO), since the CPU 216*a* cannot perform a process related to the switching of the operation mode, the CPU 216*a* moves to step S299. When the CPU 216*a* normally reads the value (S295: YES), the CPU 216*a* decides whether or not the read value is "0" (S296).

When the CPU 216*a* decides that the read value is "0" (S296: YES), that is, when an ordinary drum 220Da is attached to an apparatus main body, the CPU 216*a* moves to the step S299. In this case, for the drum unit 220D, the operation mode is not switched and the current operation mode is maintained.

On the other hand, when the CPU 216*a* decides that the read value is not "0" (S296: NO), that is, the switching drum unit 220Db is attached to the apparatus main body, the CPU 216*a* switches the operation mode in accordance with the read value (S297). Specifically, when the read value is "1", the CPU 216*a* rewrites the operation mode information held in the RAM 216*c* and the main body memory 214 to the "drum permitting mode". Thus, when the "drum inhibiting mode" is held in the main body memory 214, the drum inhibiting mode is switched to the drum permitting mode. When the "drum permitting mode" is held in the main body memory 214, consequently, the operation mode is not switched for the drum unit 220D. Further, when the read value is "2", the CPU 216*a* rewrites the operation mode information held in the RAM 216*c* and the main body memory 214 to the "drum inhibiting mode". Thus, when the "drum permitting mode" is held in the main body memory 214, the drum permitting mode is switched to the drum inhibiting mode. When the "drum inhibiting mode" is held in the main body memory 214, consequently, the operation mode is not switched for the drum unit 220D.

When the CPU 216 completes the switching process of the operation mode, the CPU 216*a* performs a process for nullifying operation mode switching information held in the drum unit 220D (S298). Specifically, the CPU 216*a* rewrites the value held in the prescribed storing area 221*a* of the unit memory 221 of the drum unit 220D to "0".

At the step S299, the same processes as the steps S294 to 298 are carried out for the toner unit 220T.

At step S300, the CPU 216*a* controls the image forming apparatus 600 in accordance with the operation mode information held in the RAM 216*c*. Specifically, for the drum unit 220D, when the operation mode information indicates the "drum inhibiting mode", the CPU 216*a* inhibits the use of the unapproved part. When the operation mode information indicates "the drum permitting mode", the CPU 216*a* permits the use of the unapproved part. Further, for the toner unit 220T, when the operation mode information indicates the "toner inhibiting mode", the CPU 216*a* inhibits the use of the unapproved part. When the operation mode information indicates the "toner permitting mode", the CPU 216*a* permits the use of the unapproved part.

In this embodiment, the operation mode is switched between the drum inhibiting mode and the drum permitting mode by the switching drum unit 220Db. The operation mode is switched between the toner inhibiting mode and the toner permitting mode by the switching toner unit 220Tb. However, for example, both the switching operations may be performed by either the switching drum unit 220Db or the switching toner unit 220Tb. Further, both the switching operations may be carried out by other replaceable parts 220 such as a transfer unit.

As described above, in this embodiment, the apparatus main body 210 has multiple groups of operation modes composed of multiple operation modes. Here, the apparatus main body has the group of operation modes including the drum inhibiting mode and the drum permitting mode and the group of operation modes including the toner inhibiting mode and the toner permitting mode. Then, the apparatus main body 210 switches the operation mode for each of the groups of operation modes in accordance with the operation mode switching information. Therefore, an optimum operation mode pattern suitable for various circumstances, such including user preferences, can be provided by a simple switching operation.

In the above-described embodiments, examples in which the operation mode is switched between the two operation modes are described. However, the operation mode may be selectively switched between three or more operation modes. For example, when the operation mode is switched between an operation mode 1, an operation mode 2, . . . , an operation mode N, in the storing area 221*a* of the switching replaceable parts 220*b*, "1", "2" . . . and "N" showing that the operation mode is to be switched respectively to the operation modes may be held.

Further, although in the above-described embodiments, examples that the operation mode is switched between the inhibiting mode and the permitting mode are described, the operation mode is not limited thereto. For example, the operation mode may be switched among multiple operation modes in which accounting methods for a maintenance charge are mutually different. As the accounting methods for the maintenance charge, as widely known, a method for counting the number of image forming sheets and charging based on the counted value, and a method that a maintenance charge is included in the price of the replaceable parts 220 may be exemplified. For operation in countries or areas where the use of a frequency band of a non-contact communication is restricted, the operation mode may be switched between a mode for performing a non-contact communication with the unit memory 221 and a mode in which the non-contact communication with the unit memory is not performed. Further, for use in areas where rougher paper having inferior fixing characteristics is common, the operation mode may be switched between an ordinary mode and a rough sheet mode in which fixing temperature is set to be high. Further, for use in multiple locations where temperatures are relatively high, normal, and relatively low, the operation mode may be switched between a high temperature mode, an ordinary mode and a low temperature mode in which ON/OFF settings of various types of heaters or fixing temperature settings are different.

The present invention is not limited to the above-described embodiments and various changes may be made within a scope without departing the gist of the present invention.

The entire disclosures of Japanese Patent Application No. 2004-135290 filed on Apr. 30, 2004 and Japanese Patent Application No. 2004-159082 filed on May 28, 2004 including specification, claims, drawings, and abstract are incorporated herein by reference.

What is claimed is:

1. An image forming apparatus comprising:

an image forming section to which a replaceable part is detachably attached; and a switching section that switches an operation mode of the image forming section to an approved part mode corresponding to a case wherein an approved part is attached as the replaceable part, and to an unapproved part mode corresponding to a case wherein a part other than the approved part is attached, wherein the image forming section obtains attribute information of the replaceable part from the replaceable part and operates in accordance with the attribute information in the approved part mode, and operates in accordance with information previously stored in the image forming section without using the attribute information in the unapproved part mode.

2. An image forming apparatus comprising:

an image forming section to which a replaceable part is detachably attached; and a switching section that switches an operation mode of the image forming section to an approved part mode corresponding to a case wherein an approved part is attached as the replaceable part, and to an unapproved part mode corresponding to a case wherein a part other than the approved part is attached, wherein the image forming section obtains attribute information of the replaceable part from the replaceable part and realizes a prescribed function by using the attribute information in the approved part mode, and disables the prescribed function in the unapproved part mode.

3. A part detachable device comprising:

an operating section to which a replaceable part is detachably attached; and a switching section that switches an operation mode of the operating section to an approved part mode corresponding to a case wherein an approved part is attached as the replaceable part and to an unapproved part mode corresponding to a ease wherein a part other than the approved part is attached, wherein the operating section obtains attribute information of the replaceable part from the replaceable part and operates in accordance with the attribute information in the approved part mode, and operates on the basis of information previously stored in the operating section without using the attribute information in the unapproved part mode.

4. A part detachable device comprising:

an operating section to which a replaceable part is detachably attached; and a switching section that switches an operation mode of the operating section to an approved part mode corresponding to a case wherein an approved part is attached as the replaceable part and to an unapproved part mode corresponding to a case wherein a part other than the approved part is attached, wherein the operating section obtains attribute information of the replaceable part from the replaceable part and realizes a prescribed function by using the attribute information in the approved part mode, and disables the prescribed function in the unapproved part mode.

5. An image forming apparatus for forming an image on a recording medium, the image forming apparatus comprising:

an image forming apparatus main body having a plurality of operation modes and a replaceable part detachably attached to the image forming apparatus main body, wherein operation mode switching information for switching the operation modes of the image forming apparatus main body is stored in the replaceable part, and the image forming apparatus main body switches the operation modes in accordance with the operation mode switching information stored in the replaceable part when the replaceable part is attached.

6. The image forming apparatus according to claim 5, wherein when the image forming apparatus main body switches the operation mode in accordance with the operation mode switching information held by the replaceable part, the image forming apparatus main body nullifies the operation mode switching information stored in the replaceable part.

7. The image forming apparatus according to claim 5, wherein in the replaceable part is pre-stored individual identifying information of the image forming apparatus main body whose operation mode is to be switched together with the operation mode switching information, and the image forming apparatus main body switches the operation mode when the individual identifying information held by the replaceable part corresponds to the individual identifying information of the image forming apparatus main body.

8. The image forming apparatus according to claim 7, wherein the individual identifying information can be provided to the replaceable part only by using a special tool.

9. The image forming apparatus according to claim 5, wherein the operation mode switching information can be provided to the replaceable part only by using a special tool.

10. The image forming apparatus according to claim 5, wherein the image forming apparatus main body has a plurality of groups of operation modes composed of a plurality of operation modes and switches the operation mode of each group of operation modes in accordance with the operation mode switching information.

11. The image forming apparatus according to claim 5, wherein the image forming apparatus main body switches the operation mode between an inhibiting mode for inhibiting the use of the replaceable part whose use is not approved by a manufacturer and a permitting mode for permitting the use of the replaceable part.

12. An image forming apparatus for forming an image on a recording medium, the image forming apparatus comprising:

an image forming apparatus main body having a plurality of operation modes and a replaceable part detachably attached to the image forming apparatus main body, wherein the replaceable part is chosen from a set including at least two types of replaceable parts, including a switching replaceable part in which is pre-stored operation mode switching information for switching the operation mode of the image forming apparatus main body and an ordinary replaceable part that does not hold such information, and the image forming apparatus main body switches the operation mode on the basis of the operation mode switching information held by the replaceable part when the switching replaceable part is attached, and maintains a current operation mode when the ordinary replaceable part is attached.

13. An image forming apparatus for forming an image on a recording medium, the image forming apparatus comprising:

an image forming apparatus main body having a plurality of operation modes, and a plurality of replaceable parts detachably attached to the image forming apparatus main body, wherein each of the plurality of replaceable parts is chosen from a set comprising at least two types of replaceable parts, including switching replaceable parts in which is pre-stored operation mode switching information for switching the operation mode of the image forming apparatus main body and ordinary replaceable parts that do not hold such information, and, when a plurality of the switching replaceable parts are attached in a prescribed combination, the image forming apparatus main body switches the operation mode on the basis of the operation mode switching information held by the replaceable parts, and otherwise maintains a current operation mode.

14. An image forming apparatus main body having a plurality of operation modes and which forms an image on a recording medium using a detachably attached replaceable part, the image forming apparatus main body comprising:

an attaching section to which a replaceable part holding operation mode switching information for switching the operation modes can be attached, and an operation mode switching section that switches the operation mode on the basis of the operation mode switching information held by the replaceable part when the replaceable part is attached to the attaching section.

15. An image forming apparatus main body having a plurality of operation modes and which forms an image on a recording medium using a detachably attached replaceable part, the image forming apparatus main body comprising:

an attaching section to which at least two types of replaceable parts, including a switching replaceable part holding operation mode switching information for switching the operation modes and an ordinary replaceable part holding no such information can be attached and an operation mode switching section that switches the operation mode in accordance with the operation mode switching information held by the replaceable part when the switching replaceable part is attached to the attaching section, and maintains a current operation mode when the ordinary replaceable part is attached to the attaching section.

* * * * *